US011138925B1

(12) United States Patent
Wang et al.

(10) Patent No.: US 11,138,925 B1
(45) Date of Patent: Oct. 5, 2021

(54) DRIVING CIRCUIT, DRIVE METHOD, AND DISPLAY DEVICE

(71) Applicant: Shanghai Tianma Micro-Electronics Co., Ltd., Shanghai (CN)

(72) Inventors: Lihua Wang, Shanghai (CN); Xiaodong Yang, Shanghai (CN); Yang Nan, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 16/933,077

(22) Filed: Jul. 20, 2020

(30) Foreign Application Priority Data

May 29, 2020 (CN) ..... 202010474282.4

(51) Int. Cl.

| | |
|---|---|
| ***G09G 5/10*** | (2006.01) |
| ***G09G 3/32*** | (2016.01) |
| ***G09G 3/325*** | (2016.01) |
| ***G09G 3/3258*** | (2016.01) |

(52) U.S. Cl.
CPC ..... *G09G 3/32* (2013.01); *G09G 3/325* (2013.01); *G09G 3/3258* (2013.01); *G09G 2300/0426* (2013.01); *G09G 2310/0272* (2013.01); *G09G 2330/02* (2013.01)

(58) Field of Classification Search
CPC ..... G09G 3/32; G09G 3/325; G09G 3/3258; G09G 2310/0272; G09G 2310/0275; G09G 2300/0426; G09G 2330/02
See application file for complete search history.

(56) References Cited

U.S. PATENT DOCUMENTS

| | | | | |
|---|---|---|---|---|
| 8,982,017 | B2 * | 3/2015 | Lee | G09G 3/3291 345/76 |
| 10,930,212 | B2 * | 2/2021 | Qian | H01L 27/3276 |
| 2013/0057532 | A1 | 3/2013 | Lee et al. | |
| 2021/0012709 | A1 * | 1/2021 | Qian | G09G 3/3233 |

FOREIGN PATENT DOCUMENTS

| | | | |
|---|---|---|---|
| CN | 1794332 | A | 6/2006 |
| CN | 201937560 | U | 8/2011 |
| CN | 108735145 | A | 11/2018 |
| CN | 105845080 | B | 9/2019 |
| KR | 100627419 | B1 | 9/2006 |

* cited by examiner

*Primary Examiner* — Vijay Shankar
(74) *Attorney, Agent, or Firm* — Anova Law Group, PLLC

(57) ABSTRACT

A driving circuit includes a first power signal terminal, a second power signal terminal, a first driving transistor, a light-emitting element, a first storage module, a first boost module, a first light-emitting control module, and a data write module. The driving circuit includes a data write stage, a boost stage, and a light-emitting stage in a same frame. At the data write stage, the data write module transmits a first data signal to the first boost node. At the boost stage, the boost signal terminal transmits a boost signal to the first boost module to increase a potential of the first boost node. At the light-emitting stage, the first light-emitting control module is in conduction, and a signal of the first boost node is transmitted to the first node.

20 Claims, 16 Drawing Sheets

DRIVING CIRCUIT, DRIVE METHOD, AND DISPLAY DEVICE

CROSS-REFERENCE TO RELATED APPLICATION

This application claims the priority of Chinese Patent Application No. 202010474282.4, filed on May 29, 2020, the content of which is incorporated herein by reference in its entirety.

TECHNICAL FIELD

The present disclosure generally relates to the field of display technology and, more particularly, relates to a driving circuit, a drive method, and a display device.

BACKGROUND

In the field of display technology, micro-LEDs and mini-LEDs have desirable development potentials in the display field, e.g., for mobile phones, televisions, and large-sized screens, because of their characteristics of high brightness, high contrast, fast response time, and the like.

The micro-LED technology (i.e., the LED miniaturization and matrix technology) is used to make an LED light source thin, miniaturized, and arrayed, such that an LED unit may be less than 50 micrometers. Similar to the OLED (organic light-emitting diode), each pixel may be individually addressed and driven to emit light (self-illumination). The mini-LED, also known as "sub-millimeter light-emitting diode", refers to the LED with a crystal grain size of approximate 100 micrometers. The size of the mini-LED is between the size of the conventional LED and the size of the micro-LED. The advantages of the micro-LEDs and mini-LEDs are that they not only inherit the characteristics of high efficiency, high brightness, high reliability, fast response time from inorganic LEDs, but also have the characteristics of self-illumination without backlight, small size, light weight, and effortlessly achieving energy-saving effect.

The micro-LEDs and min-LEDs are driven by driving transistors to emit light. The existing transistors include at least low temperature polysilicon (LTPS) transistors and amorphous silicon transistors. The low temperature polysilicon transistors have a high electron mobility and may be used as driving transistors in driving circuits; however, the process flow is complicated with high cost. The process of amorphous silicon transistors is well-developed with low cost, but the electron mobility of amorphous silicon transistors is extremely low. When amorphous silicon transistors are used as driving transistors, the drive current is extremely small, and the existing design may not meet the drive requirements of the micro-LEDs and mini-LEDs.

SUMMARY

One aspect of the present disclosure provides a driving circuit. The driving circuit includes a first power signal terminal and a second power signal terminal. The driving circuit further includes a first driving transistor, where a gate electrode of the first driving transistor is connected to a first node, and a first electrode of the first driving transistor is connected to the first power signal terminal. The driving circuit further includes a light-emitting element, connected in series between a second electrode of the first driving transistor and the second power signal terminal. The driving circuit further includes a first storage module, where a first terminal of the first storage module is connected to a fixed voltage signal, and a second terminal of the first storage module is electrically connected to the first node. The driving circuit further includes a first boost module, where a first terminal of the first boost module is connected to a boost signal terminal, and a second terminal of the first boost module is electrically connected to a first boost node. The driving circuit further includes a first light-emitting control module, connected in series between the first node and the first boost node. The driving circuit further includes a data write module, where a control terminal of the data write module is connected to a data write control terminal, a first terminal of the data write module is connected to a data signal terminal, and a second terminal of the data write module is electrically connected to the first boost node. The driving circuit includes a data write stage, a boost stage, and a light-emitting stage in a same frame. At the data write stage, the data write module transmits a first data signal to the first boost node; at the boost stage, the boost signal terminal transmits a boost signal to the first boost module to increase a potential of the first boost node, where polarities of voltages corresponding to the boost signal and the first data signal are same; and at the light-emitting stage, the first light-emitting control module is in conduction, and a signal of the first boost node is transmitted to the first node.

Another aspect of the present disclosure provides a display device including the above-mentioned driving circuit. The driving circuit includes a first power signal terminal and a second power signal terminal. The driving circuit further includes a first driving transistor, where a gate electrode of the first driving transistor is connected to a first node, and a first electrode of the first driving transistor is connected to the first power signal terminal. The driving circuit further includes a light-emitting element, connected in series between a second electrode of the first driving transistor and the second power signal terminal. The driving circuit further includes a first storage module, where a first terminal of the first storage module is connected to a fixed voltage signal, and a second terminal of the first storage module is electrically connected to the first node. The driving circuit further includes a first boost module, where a first terminal of the first boost module is connected to a boost signal terminal, and a second terminal of the first boost module is electrically connected to a first boost node. The driving circuit further includes a first light-emitting control module, connected in series between the first node and the first boost node. The driving circuit further includes a data write module, where a control terminal of the data write module is connected to a data write control terminal, a first terminal of the data write module is connected to a data signal terminal, and a second terminal of the data write module is electrically connected to the first boost node. The driving circuit includes a data write stage, a boost stage, and a light-emitting stage in a same frame. At the data write stage, the data write module transmits a first data signal to the first boost node; at the boost stage, the boost signal terminal transmits a boost signal to the first boost module to increase a potential of the first boost node, where polarities of voltages corresponding to the boost signal and the first data signal are same; and at the light-emitting stage, the first light-emitting control module is in conduction, and a signal of the first boost node is transmitted to the first node.

Another aspect of the present disclosure provides a drive method of the above-mentioned driving circuit. The driving circuit includes a first power signal terminal and a second power signal terminal. The driving circuit further includes a first driving transistor, where a gate electrode of the first driving transistor is connected to a first node, and a first electrode of the first driving transistor is connected to the first power signal terminal. The driving circuit further includes a light-emitting element, connected in series between a second electrode of the first driving transistor and the second power signal terminal. The driving circuit further includes a first storage module, where a first terminal of the first storage module is connected to a fixed voltage signal, and a second terminal of the first storage module is electrically connected to the first node. The driving circuit further includes a first boost module, where a first terminal of the first boost module is connected to a boost signal terminal, and a second terminal of the first boost module is electrically connected to a first boost node. The driving circuit further includes a first light-emitting control module, connected in series between the first node and the first boost node. The driving circuit further includes a data write module, where a control terminal of the data write module is connected to a data write control terminal, a first terminal of the data write module is connected to a data signal terminal, and a second terminal of the data write module is electrically connected to the first boost node. The driving circuit includes a data write stage, a boost stage, and a light-emitting stage in a same frame. At the data write stage, the data write module transmits a first data signal to the first boost node; at the boost stage, the boost signal terminal transmits a boost signal to the first boost module to increase a potential of the first boost node, where polarities of voltages corresponding to the boost signal and the first data signal are same; and at the light-emitting stage, the first light-emitting control module is in conduction, and a signal of the first boost node is transmitted to the first node.

Other aspects of the present disclosure may be understood by those skilled in the art in light of the description, the claims, and the drawings of the present disclosure.

BRIEF DESCRIPTION OF THE DRAWINGS

Drawings incorporated in the specification and forming a part of the specification demonstrate the embodiments of the present disclosure and, together with the specification, describe the principles of the present disclosure.

DETAILED DESCRIPTION

Figure 1:
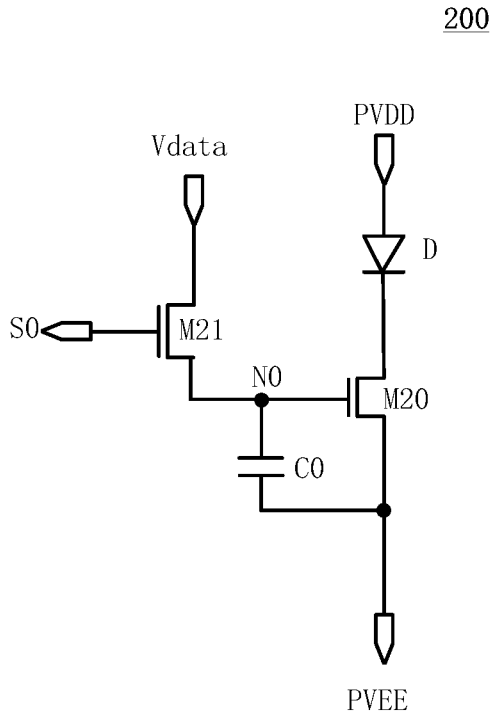
FIG. 1 illustrates a structural schematic of a driving circuit provided by an existing technology.

Various exemplary embodiments of the present disclosure are described in detail with reference to the drawings. It should be noted that the relative arrangement of components and steps, numerical expressions, and numerical values set forth in the embodiments may not limit the scope of the present disclosure unless specifically stated otherwise.

The following description of at least one exemplary embodiment is merely illustrative, which may not limit the present disclosure and its application or use.

Techniques, methods and equipment known to those skilled in the art may not be discussed in detail, but where appropriate, the techniques, methods and equipment should be considered as a part of the specification.

In all exemplary embodiments shown and discussed herein, any specific values should be interpreted as merely exemplary and not limiting. Therefore, other examples of the exemplary embodiments may have different values.

It should be noted that similar reference numerals and letters indicate similar items in the following drawings. Therefore, once an item is defined in one drawing, there is no need to discuss it further in subsequent drawings.

FIG. 1 illustrates a structural schematic of a driving circuit provided by an existing technology. A driving circuit 200 may include a driving transistor M20, a switch transistor M21, and a storage capacitor C0. At a display stage, the switch transistor M21 may be in conduction; a data signal terminal Vdata may transmit a data signal to a node NO; the storage capacitor C0 may be configured to maintain the potential of the node NO; a current for driving a light-emitting element D to emit light may be generated by the driving transistor M20 according to a voltage of the node NO and a threshold voltage; and the magnitude of the drive current may be positively related to the voltage outputted from the data signal terminal Vdata of the node NO. The data signal terminal Vdata may be electrically connected to an IC, and the existing IC may not output relatively high voltage. For example, the relative high voltage outputted by the IC is 6V. When the amorphous silicon transistor with low electron mobility and low manufacturing cost is used as the driving transistor M20, the output current corresponding to the voltage of 6V may be only 0.03 mA, which is extremely lower than the drive requirement of the micro-LEDs and mini-LEDs. Therefore, there is a need to effectively increase the potential of the gate of the driving transistor in the driving circuit to increase the drive current of the driving circuit.

To overcome the above-mentioned disadvantages, the present disclosure provides a driving circuit, a drive method, and a display device. A first boost module is introduced to increase the potential of the gate of the driving transistor, which may be beneficial for reducing the manufacturing cost while increasing the drive current.

Figure 2:
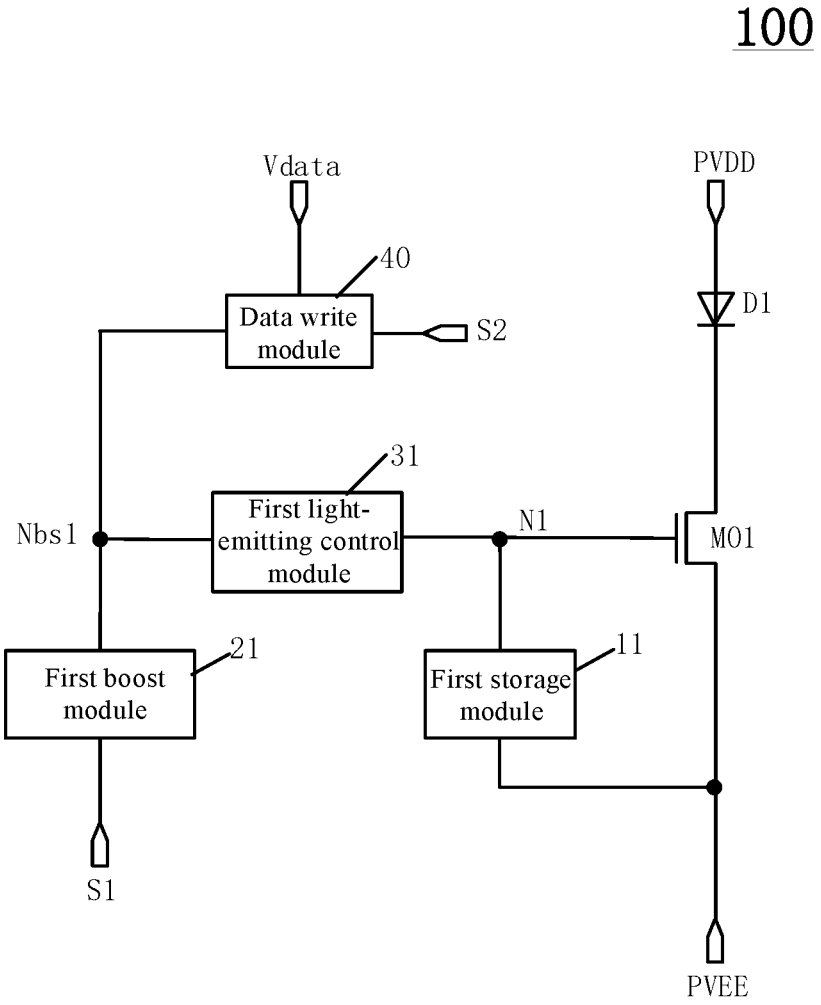
FIG. 2 illustrates a structural schematic of a driving circuit according to exemplary embodiments of the present disclosure.

FIG. 2 illustrates a structural schematic of a driving circuit according to exemplary embodiments of the present disclosure. Referring to FIG. 2, a driving circuit 100 provided by the present disclosure may include the following:

a first power signal terminal PVEE and a second power signal terminal PVDD;

a first driving transistor M01, where the gate of the first driving transistor M01 may be connected to a first node N1, and the first electrode of the first driving transistor M01 may be connected to the first power signal terminal PVEE;

a light-emitting element D1, which may be connected in series between the second electrode of the first driving transistor M01 and the second power signal terminal PVDD;

a first storage module 11, where the first terminal of the first storage module 11 may be connected to a fixed voltage signal, and the second terminal of the first storage module 11 may be electrically connected to the first node N1; and optionally, the first terminal of the first storage module 11 may be connected to the first power signal terminal PVEE;

a first boost module 21, where the first terminal of the first boost module 21 may be connected to a boost signal terminal S1, and the second terminal of the first boost module 21 may be electrically connected to a first boost node Nbs1;

a first light-emitting control module 31, which may be connected in series between the first node N1 and the first boost node Nbs1; and a data write module 40, where the control terminal of the data write module 40 may be connected to a data write control terminal S2, the first terminal of the data write module 40 may be connected to a data signal terminal Vdata, and the second terminal of the data write module 40 may be electrically connected to the first boost node Nbs1.

In a same frame, the driving circuit 100 may include a data write stage, a boost stage, and a light-emitting stage. At the data write stage, the data write module 40 may transmit a first data signal to the first boost node Nbs1. At the boost stage, the boost signal terminal S1 may transmit a boost signal to the first boost module 21 to increase the potential of the first boost node Nbs1, where polarities of voltages corresponding to the boost signal and the first data signal may be same. At the light-emitting stage, the first light-emitting control module 31 may be in conduction, and the signal of the first boost node Nbs1 may be transmitted to the first node N1.

It should be noted that FIG. 2 may only show one frame structure of the pixel driving circuit 100 in the present application. In some other embodiments of the present application, the frame structures of the pixel driving circuit 100 may include other structures, which may not be limited in the present application.

Optionally, in the present application, the first power signal terminal PVEE may be, for example, a ground terminal, and the second power signal terminal PVDD may be, for example, a positive voltage signal terminal. Optionally, the light-emitting element D1 in the present application may be, for example, any one of an LED, a mini-LED, and a micro-LED; and one driving circuit 100 may drive one or more light-emitting elements accordingly, which may not be limited in the present application according to the embodiments of the present disclosure.

For example, referring to FIG. 2, the first boost module 21 and the first boost node Nbs1 may be introduced in the driving circuit 100 provided by the present disclosure. In the same frame, at the data write stage, the data write module 40 may transmit the first data signal to the first boost node Nbs1; at the boost stage, the first boost module 21 may receive the boost signal from the boost signal terminal S1 to increase the potential of the first boost node Nbs1, where, in particular, the polarities of the voltages corresponding to the boost signal and the first data signal may be same; and at the light-emitting stage, the first light-emitting control module 31 between the first boost node Nbs1 and the first node N1 may be in conduction, and the signal of the first boost node Nbs1 may be transmitted to the first node N1. At this point, the potential of the first node N1 may be increased compared with the potential when the first boost module 12 is not introduced. The difference between the voltage of the first node N1 and the threshold voltage of the first driving transistor M01 is proportional to the magnitude of the drive current. In such way, when the potential of the first node N1 of the first driving transistor M01 increases, the difference between the voltage of the first node N1 and the threshold voltage of the first driving transistor M01 may become greater, thereby making the drive current greater. Therefore, without changing the voltage corresponding to the first data signal provided by the data write module 40, the first boost module 21 may be introduced to increase the drive current of the driving circuit 100. Even if the amorphous silicon transistor with low electron mobility and low cost is used as the first driving transistor M01 in the driving circuit 100 provided by the present application, the drive requirement may also be satisfied, thereby simplifying the manufacturing process and reducing the manufacturing cost while increasing the drive current.

In the existing driving circuit, at the data write stage, the data signal of the data signal terminal Vdata may be written into the first node N1 through the driving transistor and a compensation module. Since the maximum voltage inputted by the data signal terminal Vdata is limited, for the driving transistors in the existing technology, transistors with high electron mobility such as low temperature polysilicon transistors may only be suitable, and transistors with low electron mobility such as amorphous silicon transistors may not be suitable. However, due to the complicated manufacturing process flow and high cost of the low temperature polysilicon transistors, the manufacturing process of the existing driving circuit may be complicated with high cost. After introducing the first boost circuit into the driving circuit in the present application, it may effectively increase the potential of the first node N1. When using the transistor with low electron mobility such as the amorphous silicon transistor, the first driving transistor may also generate a relatively high drive current. Therefore, the driving circuit provided in the present application may make it possible to replace the low temperature polysilicon transistor with the amorphous silicon transistor, which is beneficial for simplifying the manufacturing process and reducing the manufacturing cost.

Figure 3:
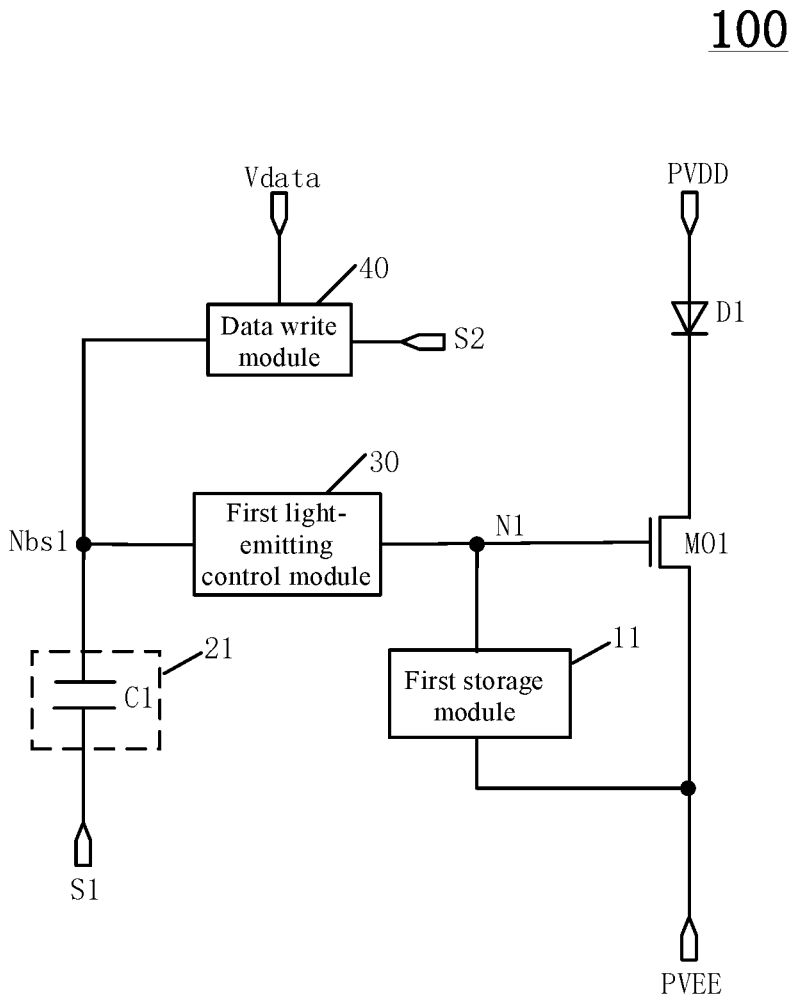
FIG. 3 illustrates another structural schematic of a driving circuit according to exemplary embodiments of the present disclosure.

In one optional embodiment of the present disclosure, FIG. 3 illustrates another structural schematic of the driving circuit 100 according to exemplary embodiments of the present disclosure. The first boost module 21 may include a first capacitor C1, where the first electrode of the first capacitor C1 may be used as the first terminal of the first boost module 21, and the second electrode of the first capacitor C1 may be used as the second terminal of the first boost module 21.

For example, the structure shown in FIG. 3 is a further refinement of the first boost module 21 based on the structure of the driving circuit 100 in FIG. 2, and the first boost module 21 in one embodiment may be embodies as the first capacitor C1. At the boost stage, the boost signal terminal S1 may transmit the boost signal to one electrode of the first capacitor C1 to charge the first capacitor C1. Considering the characteristics for the capacitor itself, when one electrode of the first capacitor C1 transmits the boost signal, the potential of the other electrode of the first capacitor C1 may increase accordingly, and the potential corresponding to the first boost node Nbs1 in FIG. 3 may increase accordingly. For example, assuming that the voltage difference between two electrodes of the first capacitor C1 is a fixed 6V, when the boost signal terminal inputs a voltage of 5V to one electrode, the voltage of the other electrode may increase to 11V. Since the other electrode of the first capacitor is equipotential with the first boost node Nbs1, the voltage of the first boost node Nbs1 may also increase to 11V, thereby implementing the effect of boosting the potential of the first boost node. The use of the capacitor as the first boost module 21 in the present application may have a simple structure and may not require the introduction of a complicated circuit structure in the driving circuit 100, which may be beneficial for simplifying the overall structure of the driving circuit 100 after the introduction of the first boost module.

In one optional embodiment of the present disclosure, the capacitance value of the first capacitor C1 may be less than or equal to 50 pF. When the capacitance value of the first capacitor 1 is less than 50 pF, the first capacitor C1 may be charged through the boost signal terminal S1, which is sufficient to increase the potential of the first boost node Nbs1, such that the drive current generated in the light-emitting stage meets the drive requirement. If the capacitance value is too large (e.g., greater than 50 pF), the volume of the capacitor may be relatively large. When the driving circuit 100 is applied to the display device, the first capacitor C1 may occupy a relatively large space, which is not beneficial for improving the screen-to-body ratio of the display device. Therefore, the capacitance value of the first capacitor C1 may be set at 50 pF or less, which is beneficial for improving the screen-to-body ratio of the display device.

Figure 4:
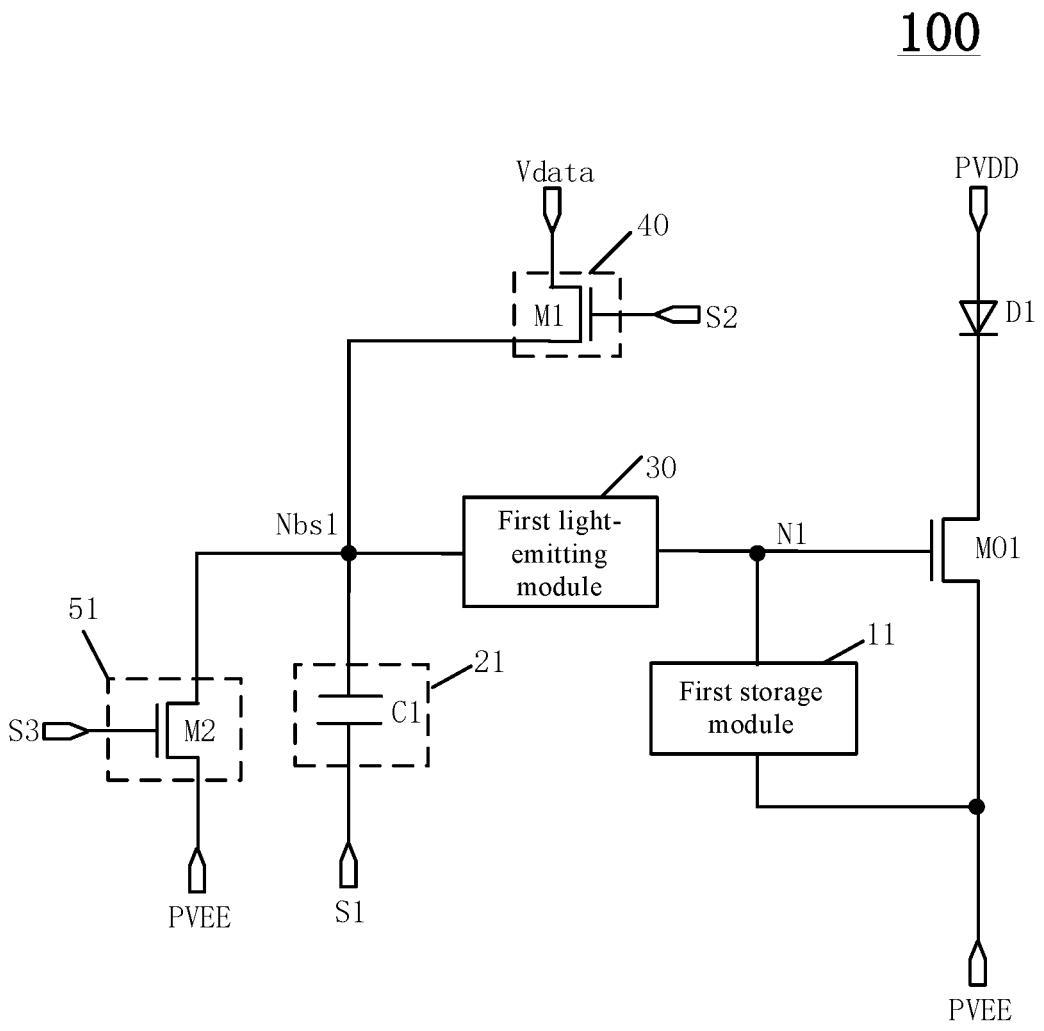
FIG. 4 illustrates another structural schematic of a driving circuit according to exemplary embodiments of the present disclosure.

In one optional embodiment of the present disclosure, FIG. 4 illustrates another structural schematic of the driving circuit 100 according to exemplary embodiments of the present disclosure. The driving circuit 100 may further include a first reset module 51. The control terminal of the first reset module 51 may be connected to a first reset control terminal S3, the first terminal of the first reset module 51 may be electrically connected to the first boost node Nbs1, and the second terminal of the first reset module 51 may be electrically connected to the first power signal terminal PVEE.

Referring to FIG. 4, the first reset module 51 is introduced in the driving circuit 100 to reset the first boost node Nbs1 in the present application. For example, in a frame time, the data write module 40 may write the data signal to the first boost node Nbs1, and the first boost module 21 may increase the potential of the first boost node Nbs1; at the light-emitting stage, the signal of the first boost node Nbs1 may be transmitted to the first node N1, such that the first driving transistor M01 may generate a relatively large drive current to drive the light-emitting element D1 to emit light. In a next frame time, before writing the data signal to the first boost node Nbs1, the first reset module 51 may first be used to reset the first boost node Nbs1. Therefore, before the data write module 40 transmits the data signal to the first boost node Nbs1 in each frame time, the potentials of the first boost node Nbs1 may be same, which is beneficial for improving the accuracy of the data signal transmission in the driving circuit 100. Optionally, the data write module 40 may include a first transistor M1, and the first reset module 51 may include a second transistor M2. When resetting the first boost node Nbs1, the first reset control terminal may control the second transistor M2 to be in conduction, and the signal of the first power supply signal terminal PVEE may be transmitted to the first boost node Nbs1 through the second transistor M2. When the first power supply signal terminal PVEE is the ground terminal, the potential of the first boost node Nbs1 may be reset to zero.

Figure 5:
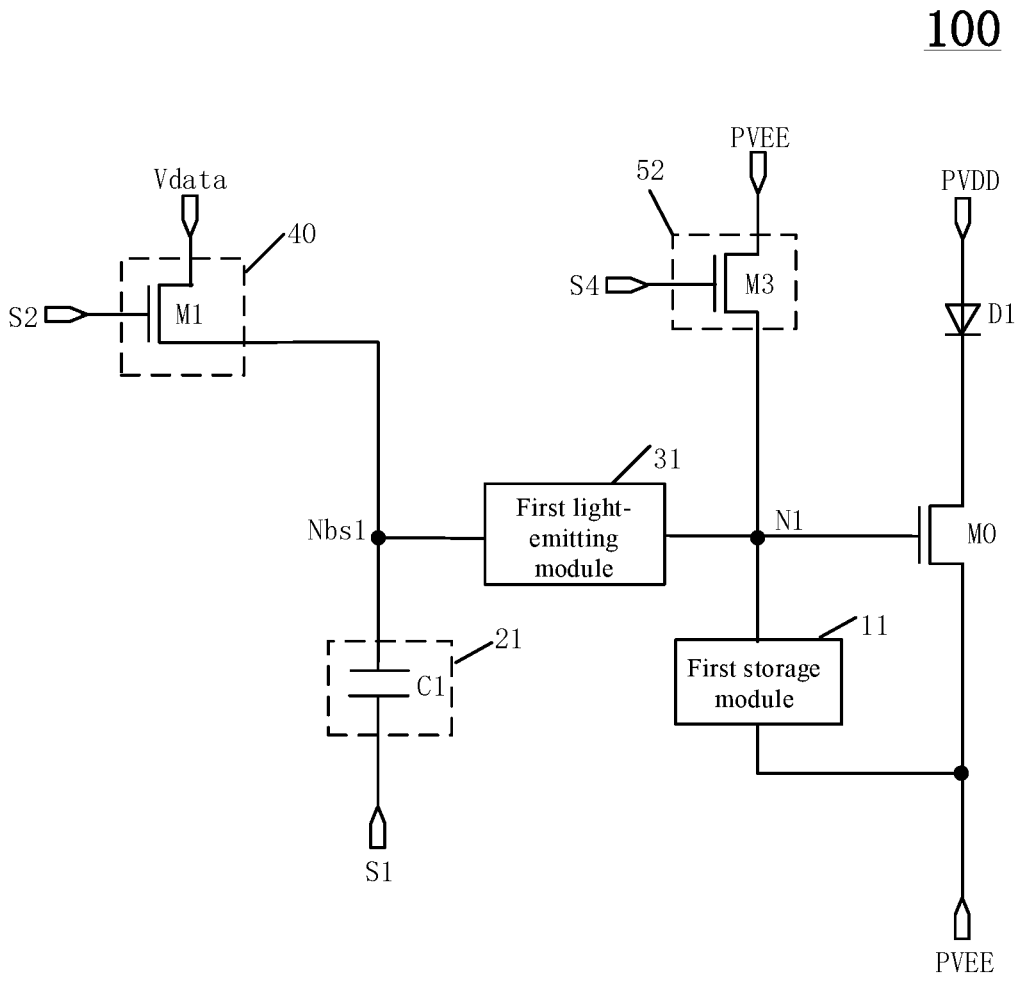
FIG. 5 illustrates another structural schematic of a driving circuit according to exemplary embodiments of the present disclosure.

In one optional embodiment of the present disclosure, FIG. 5 illustrates another structural schematic of the driving circuit 100 according to exemplary embodiments of the present disclosure. The driving circuit 100 may further include a second reset module 52. The control terminal of the second reset module 52 may be connected to a second reset control terminal S4, the first terminal of the second reset module 52 may be electrically connected to the first node N1, and the second terminal of the second reset module 52 may be electrically connected to the first power signal terminal PVEE.

Referring to FIG. 5, the second reset module 52 may be introduced in the driving circuit 100 to reset the first node N1 in the present application. For example, in the light-emitting stage of one frame time, the first light-emitting control module 31 may be in conduction, and the signal of the first boost node Nbs1 may be transmitted to the first node N1, such that the first driving transistor M01 may generate a relatively large drive current to drive the light-emitting element D1 to emit light. In a next frame time, the second reset module 52 in the present application may be used to reset the first node N1 before performing the light-emitting stage. Therefore, before the first boost node Nbs1 transmits the data signal to the first node N1 during the light-emitting stage in each frame time, the potentials of the first boost node Nbs1 may be same, which is beneficial for improving the data accuracy of the first node N1, thereby enabling the light-emitting element D1 to emit light according to expected brightness. Optionally, the second rest module 52 may include a third transistor M3. At the reset stage of the first node N1, the third transistor M3 may be in conduction, and the signal of the first power supply signal terminal PVEE may be transmitted to the first node N1 through the third transistor M3 to reset the first node N1. When the first power supply signal terminal PVEE is the ground terminal, the potential of the first node N1 may be reset to zero.

Figure 6:
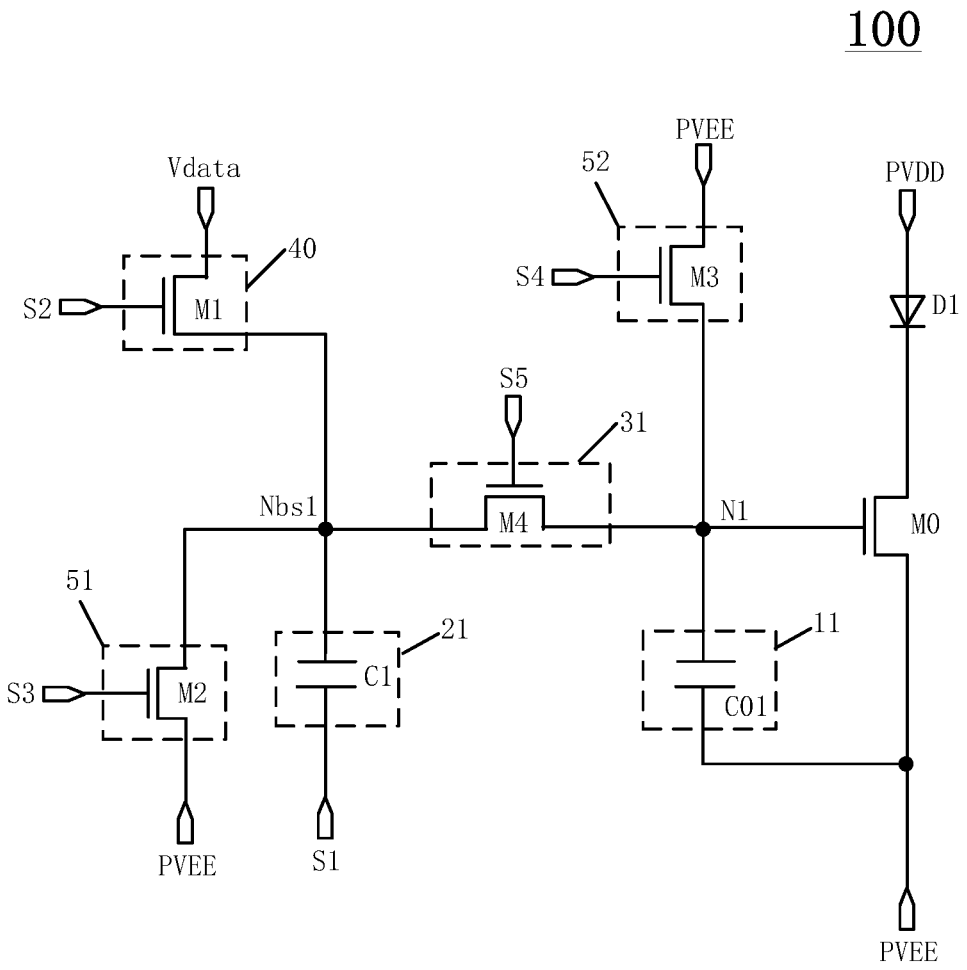
FIG. 6 illustrates a circuit structural diagram of a driving circuit according to exemplary embodiments of the present disclosure.

In one optional embodiment of the present disclosure, the driving circuit 100 may include both the first reset module 51 and the second reset module 52 mentioned above. Referring to FIG. 6, FIG. 6 illustrates a circuit structural diagram of the driving circuit 100 according to exemplary embodiments of the present disclosure. In one embodiment, the first light-emitting control module 31 may include a fourth transistor M4, the control terminal of the fourth transistor M4 may be connected to a light-emitting control signal terminal S5, and the first storage module 11 may be embodied as a capacitor C01. In the same frame, the first boost node Nbs1 may be reset first, that is, the second transistor M2 may be controlled to be in conduction, and the signal of the first power supply signal terminal PVEE may be transmitted to the first boost node Nbs1 through the second transistor M2. Next, the data write module 40 may be used to transmit the data signal to the first boost node Nbs1, that is, the first transistor M1 may be controlled to be in conduction, and the data write module 40 may transmit the first data signal to the first boost node Nbs1. Then, the first boost module 21 may be used to increase the potential of the first boost node Nbs1, and the boost signal terminal S1 may transmit the boost signal to the first capacitor C1, thereby increasing the potential of the first boost node Nbs1. Before the light-emitting stage, the second reset module 52 may be used to reset the first node N1, that is, the third transistor M3 may be controlled to be in conduction, and the signal of the first power signal terminal PVEE may be transmitted to the first node N1 through the third transistor M3. At the light-emitting stage, the fourth transistor M4 may be controlled to be in conduction, and the signal of the first boost node Nbs1 may be transmitted to the first node N1, such that the driving transistor may generate the drive current to drive the light-emitting element D1 to emit light.

Figure 7:
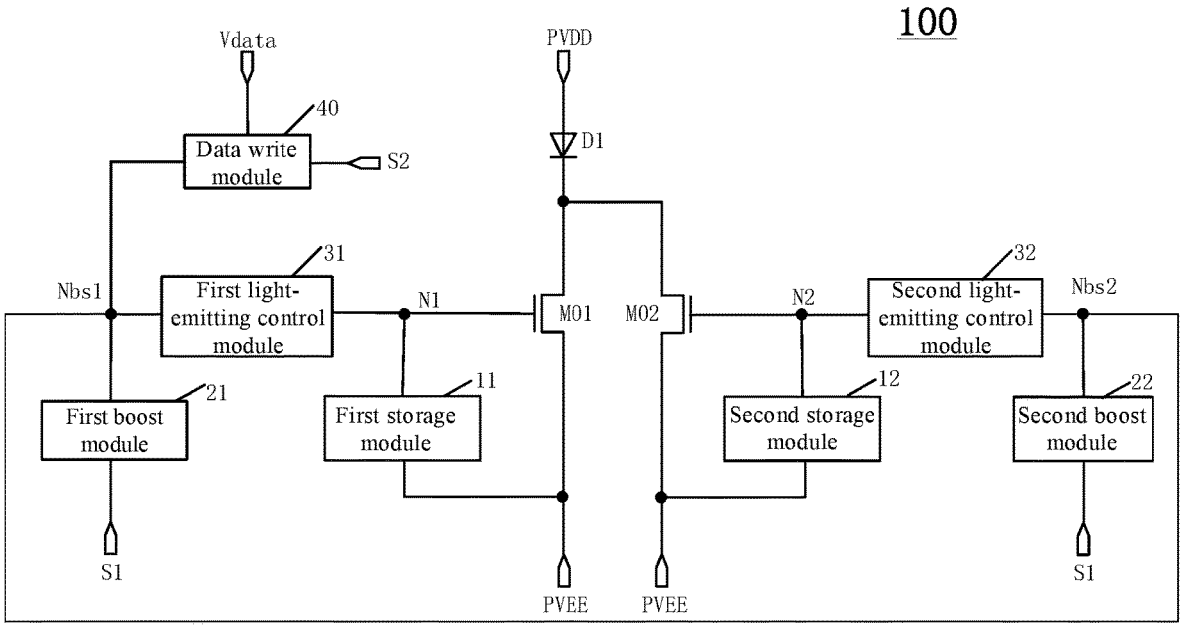
FIG. 7 illustrates another structural schematic of a driving circuit according to exemplary embodiments of the present disclosure.

In one optional embodiment of the present disclosure, FIG. 7 illustrates another structural schematic of the driving circuit 100 according to exemplary embodiments of the present disclosure. The driving circuit 100 may further include a second driving transistor M02, a second storage module 12, a second boost module 22, and a second light-emitting control module 32. The gate electrode of the second driving transistor M02 may be connected to the second node N2, the first electrode of the second driving transistor M02 may be connected to the light-emitting element D1, and the second electrode of the second driving transistor M02 may be connected to the first power signal terminal PVEE. The first terminal of the second storage module 12 may be connected to a fixed voltage signal (optionally, connected to the first power signal terminal PVEE), and the second terminal of the second storage module 12 may be electrically connected to the second node N2. The first terminal of the second boost module 22 may be connected to the boost signal terminal S1, and the second terminal of the second boost module 22 may be connected to a second boost node Nbs2. The second light-emitting control module 32 may be connected in series between the second boost node Nbs2 and the second node N2.

For example, FIG. 7 illustrates a solution where the driving circuit 100 may include two driving transistors and two boost modules. Two driving transistors may be the first driving transistor M01 and the second driving transistor M02 respectively, and two boost modules may be the first boost module 21 and the second boost module 22 respectively. The first boost module 21 may be electrically connected to the first boost node Nbs1, and the second boost module 22 may be electrically connected to the second boost node Nbs2; meanwhile, the first boost node Nbs1 and the second boost node Nbs2 may be electrically connected to each other by wiring, that is, the first boost node Nbs1 and the second boost node Nbs2 may be equipotential. At the data write stage, the data write module 40 may transmit the first data signal to the first boost node Nbs1, and simultaneously transmit the first data signal to the second boost node Nbs2; and the first boost module 21 and the second boost module 22 may be connected to a same boost signal terminal S1. At the boost stage, the boost signal terminal S1 may transmit the boost signals to the first boost module 21 and the second boost module 22 simultaneously, such that both potentials of the first boost node Nbs1 and the second boost node Nbs2 may be increased. At the light-emitting stage, both the first light-emitting control module 31 and the second light-emitting control module 32 may be in conduction, the signal of the first boost node Nbs1 may be transmitted to the first node N1, and the signal of the second boost node Nbs2 may be transmitted to the second node N2. In such way, each of the first driving transistor M01 and the second driving transistor M02 may generate a drive current to jointly drive the light-emitting element D1 to emit light. Two boost modules and two driving transistors may be introduced in the driving circuit 100 in the present application. The introduction of the first boost module 21 and the second boost module 22 may effectively increase the potentials of the gate electrodes of the first driving transistor M01 and the second driving transistor M02, thereby increasing the drive currents generated by the first driving transistor M01 and the second driving transistor M02; moreover, the drive currents generated by the first driving transistor M01 and the second driving transistor M02 may be used to jointly drive the light-emitting element D1, which further increases the magnitude of the drive current. Even if the amorphous silicon transistors with low cost are used as the first driving transistor M01 and the second driving transistor M02 in the present application, the drive current may be effectively increased, and the drive requirement of the light-emitting element D1 may be satisfied while simplifying the manufacturing process and reducing the manufacturing cost.

Figure 8:
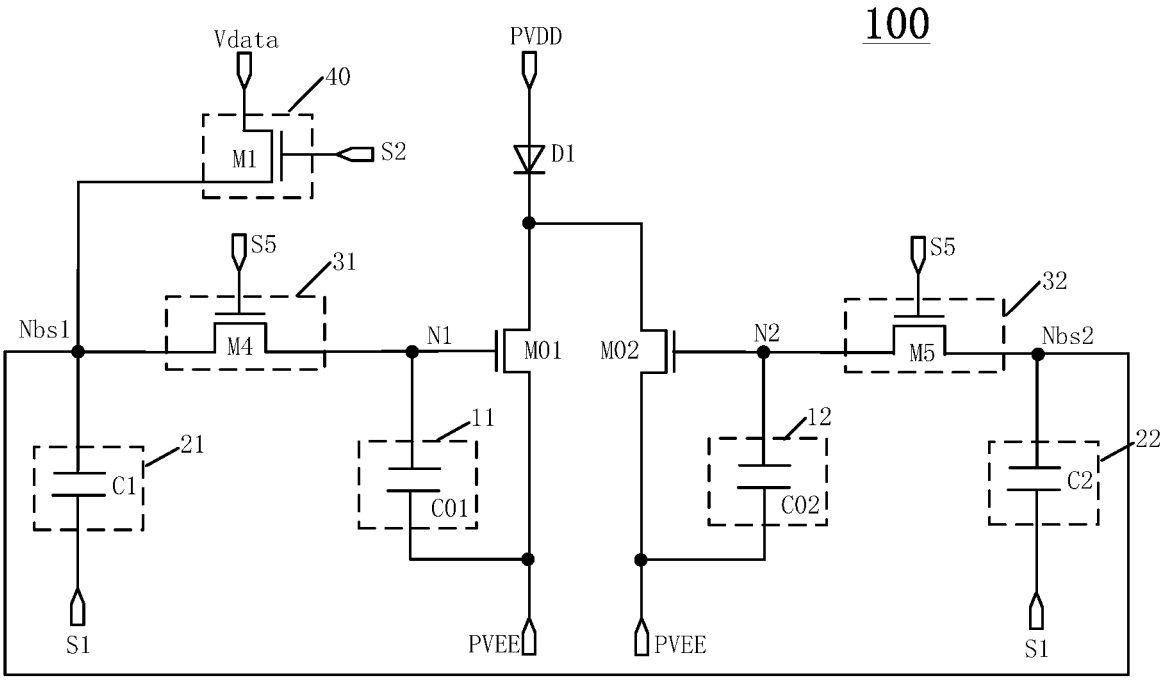
FIG. 8 illustrates another circuit structural diagram of a driving circuit according to exemplary embodiments of the present disclosure.

In one optional embodiment of the present disclosure, FIG. 8 illustrates another circuit structural diagram of the driving circuit 100 according to exemplary embodiments of the present disclosure. The second boost module 22 may include a second capacitor C2. The first electrode of the second capacitor C2 may be used as the first terminal of the second boost module 22, and the second electrode of the second capacitor C2 may be used as the second terminal of the second boost module 22.

For example, FIG. 8 illustrates a circuit structural diagram when the driving circuit 100 includes two driving transistors and two boost modules. In one embodiment, the first boost module 21 may be embodied as the first capacitor C1, the second boost module 22 may be embodied as the second capacitor C2, the first storage module 11 may be embodied as the capacitor C1, and the second storage module 12 may be embodied as the capacitor C2. At the boost stage, the boost signal terminal S1 may simultaneously transmit the boost signal to one electrode of each of the first capacitor C1 and the second capacitor C2, thereby charging the first capacitor C1 and the second capacitor C2. Considering the characteristics for the capacitor itself, when one electrode of each of the first capacitor C1 and the second capacitor C2 transmits the boost signal, the potential of the other electrode of each of the first capacitor C1 and the second capacitor C2 may increase accordingly, and the potentials corresponding to the first boost node Nbs1 and the second boost node Nbs2 in FIG. 8 may increase accordingly. The use of the capacitors as the first boost module 21 and the second boost module 22 in the present application may have a simple structure and may not require the introduction of the complicated circuit structure in the driving circuit 100, which may be beneficial for simplifying the overall structure of the driving circuit 100 after the introduction of the first boost module 21 and the second boost module 22.

Optionally, the capacitance values of the first capacitor C1 and the second capacitor C2 may be equal to each other, and the capacitance values of the capacitor C01 and the capacitor C02 corresponding to the first storage module 11 and the second storage module 12 may also be equal to each other in the present application. On the one hand, it may be beneficial for simplifying the element types in the driving circuit 100; on the other hand, the potentials of the signals transmitted to the first node N1 and the second node N2 during the light-emitting stage may be same, such that the drive currents generated by the first driving transistor M01 and the second driving transistor M02 may be close to each other.

In one optional embodiment of the present disclosure, referring to FIG. 8, the control terminals of the first light-emitting control module 31 and the second light-emitting control module 32 may be connected to the same light-emitting control signal terminal S5, and the first light-emitting control module 31 and the second light-emitting control module 32 may be in conduction simultaneously or cutoff simultaneously.

For example, referring to FIG. 8, the first light-emitting control module 31 and the second light-emitting control module 32 may be respectively embodied as the fourth transistor M4 and a fifth transistor M5 in one embodiment. The fourth transistor M4 and the fifth transistor M5 may have a same type, and the gate electrodes of the fourth transistor M4 and the fifth transistor M5 may be connected to the same light-emitting control signal terminal S5. In such way, when the light-emitting control signal terminal S5 transmits the control signal to the fourth transistor M4 and the fifth transistor M5, the fourth transistor M4 and the fifth transistor M5 may be controlled to be in conduction simultaneously or cutoff simultaneously. At the light-emitting stage, the light-emitting control signal terminal S5 may control the fourth transistor M4 and the fifth transistor M5 to be in conduction simultaneously, and the signal of the second boost node Nbs2 may be transmitted to the second node N2 while the signal of the first boost node Nbs1 is transmitted to the first node N1. In such way, the first driving transistor M01 and the second driving transistor M02 may simultaneously generate drive currents to drive the light-emitting element D1 to emit light, thereby effectively increasing the magnitude of the drive current received by the light-emitting element D1.

Figure 9:
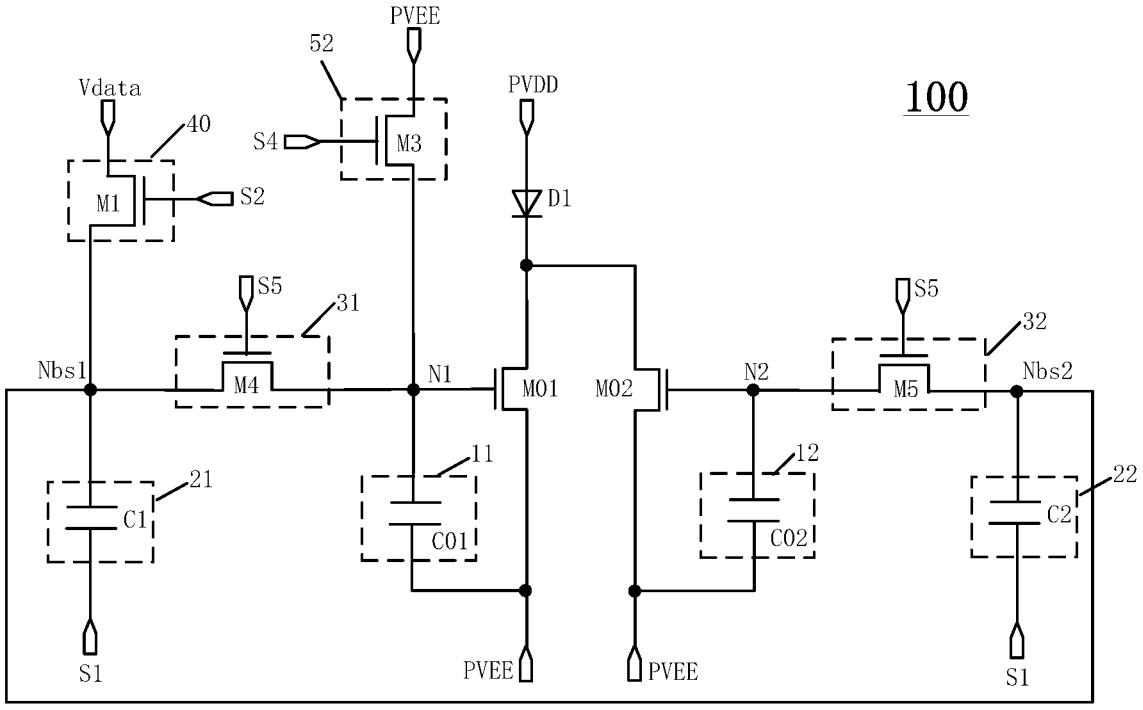
FIG. 9 illustrates another circuit structural diagram of a driving circuit according to exemplary embodiments of the present disclosure.
Figure 10:
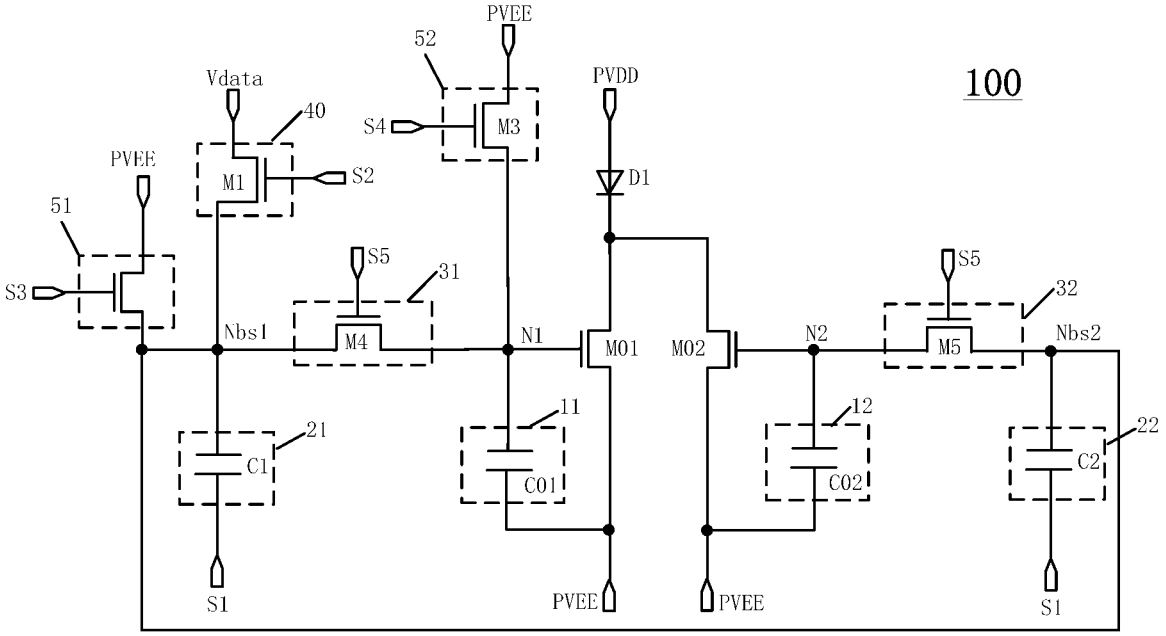
FIG. 10 illustrates another circuit structural diagram of a driving circuit according to exemplary embodiments of the present disclosure.

Optionally, FIG. 9 illustrates another circuit structural diagram of the driving circuit 100 according to exemplary embodiments of the present disclosure; and FIG. 10 illustrates another circuit structural diagram of the driving circuit 100 according to exemplary embodiments of the present disclosure. Compared with the circuit structure shown in FIG. 8, the second reset module 52 may be added to the driving circuit 100 shown in FIG. 9 to reset the first node N1; and the first reset module 51 and the second reset module 52 may be simultaneously added to the driving circuit 100 shown in FIG. 10. The driving circuits 100 shown in FIGS. 9-10 may include a boost node reset stage, a data write stage, a first node reset stage, and a light-emitting stage. At the boost node reset stage, the first reset module 51 illustrated in FIG. 10 may be used to reset the first boost node Nbs1 and the second boost node Nbs2, or a time sequence may be used to reset above-mentioned boost nodes. When the first reset module 51 is used to reset the first boost node Nbs1, the procedure may refer to the reset method in the above-mentioned embodiments. When the time sequence is used to reset the above-mentioned boost nodes, the structure shown in FIG. 9 where the first reset module 51 is introduced may be used, the data signal terminal Vdata may be controlled to transmit the second data signal to the first boost node Nbs1 and the second boost node Nbs2. At this point, the second data signal may be embodied as, for example, a ground signal, thereby implementing the reset of the first boost node Nbs1 and the second boost node Nbs2. At the data write stage, the data signal terminal Vdata may then be controlled to transmit the first data signal to the first boost node Nbs1 and the second boost node Nbs2, where the first data signal may be a data signal configured to drive the light-emitting element D1. At the boost stage, the boost signal terminal S1 may respectively transmit the boost signals to the first capacitor C1 and the second capacitor C2 to charge the first capacitor C1 and the second capacitor C2, thereby increasing the signal potentials of the first boost node Nbs1 and the second boost node Nbs2. At the reset stage of the first node N1, the second reset module 52 may be used to reset the first module N1. At the light-emitting stage, the fourth transistor M4 and the fifth transistor M5 may be controlled to be in conduction simultaneously, and the signal of the second boost node Nbs2 may be transmitted to the second node N2 while the signal of the first boost node Nbs1 is transmitted to the first node N1. In such way, the first driving transistor M01 and the second driving transistor M02 may simultaneously generate drive currents to drive the light-emitting element D1 to emit light.

In one optional embodiment of the present disclosure, the channel width-to-length ratios of the first driving transistor M01 and the second driving transistor M02 may be equal to each other. When the channel width-to-length ratios of the first driving transistor M01 and the second driving transistor M02 are set to be equal, it is equivalent that the first driving transistor M01 and the second driving transistor M02 are respectively formed using transistor devices with same specification, thereby simplifying the types of electronic devices in the driving circuit 100. Furthermore, since the channel width-to-length ratio of the transistor is closely related to the drive current which the transistor generates, when the channel width-to-length ratios of the first driving transistor M01 and the second driving transistor M02 are set to be equal and the potentials of the first node N1 and the second node N2 are same, the drive currents generated by the first driving transistor M01 and the second driving transistor M02 may have a same magnitude. Compared with the solution with only one driving transistor, it is equivalent that the magnitude of the drive current is doubled, which may be more beneficial for improving the drive capacity of the driving circuit 100 in the present application.

In one optional embodiment of the present disclosure, referring to FIGS. 9-10, the channel width-to-length ratios of the first driving transistor M01 and the second driving transistor M02 are greater than 100. For example, the greater the channel width-to-length ratio of the driving transistor is, the greater the on-state current of the corresponding driving transistor is and the smaller the conduction resistance is. When the channel width-to-length ratios of the first driving transistor M01 and the second driving transistor M02 are set to be greater than 100, the conduction resistance of the first driving transistor M01 and the second driving transistor M02 may be effectively reduced, which may be more beneficial for improving the conduction current (i.e., the drive current) of the first driving transistor M01 and the second driving transistor M02 at the light-emitting stage.

In one optional embodiment of the present disclosure, referring to FIGS. 9-10, the data write module 40 may include the first transistor M1. The gate electrode of the first transistor M1 may be used as the control terminal of the data write module 40; the first electrode of the first transistor M1 may be used as the first terminal of the data write module 40; and the second electrode of the first transistor M1 may be used as the second terminal of the data write module 40. The channel width-to-length ratio of the first transistor M1 may be less than the channel width-to-length ratio of each of the first driving transistor M01 and the second driving transistor M02.

For example, since the first transistor M1 corresponding to the data write module 40 is configured to transmit the data signal, the channel width-to-length ratio of the first transistor M1 may directly determine the transmission rate of the data signal. In the present application, when the channel width-to-length ratio of the first transistor M1 corresponding to the data write module 40 is set to be less than the channel width-to-length ratio of each of the first driving transistor M01 and the second driving transistor M02, the size of the first transistor M1 may not be too large, and the first transistor M1 may be ensured to have a certain data transmission speed.

In one optional embodiment of the present disclosure, referring to FIG. 10, the first reset module 51 may include the second transistor M2, the second reset module 52 may include the third transistor M3, the first light-emitting control module 31 may include the fourth transistor M4, and the second light-emitting control module 32 may include the fifth transistor M5. The channel width-to-length ratios of the second transistor M2, the third transistor M3, the fourth transistor M4, and the fifth transistor M5 may be equal to each other and may all be smaller than the channel width-to-length ratio of the first transistor M1.

For example, when the channel width-to-length ratios of the second transistor M2, the third transistor M3, the fourth transistor M4, and the fifth transistor M5 are set to be equal, the transistors may be formed using transistor devices with the same specification, thereby simplifying the types of electronic devices in the driving circuit 100. Furthermore, when the channel width-to-length ratio of the first transistor M1 is set to be greater than the channel width-to-length ratios of the second transistor M2, the third transistor M3, the fourth transistor M4, and the fifth transistor M5, it is beneficial to ensure the transmission speed of the data signal of the first transistor M1, thereby reducing the delay of charging the first boost node Nbs1.

Optionally, the channel width-to-length ratios of the second transistor M2, the third transistor M3, the fourth transistor M4, and the fifth transistor M5 may be set to be greater than 1 (furthermore, set to be 30u/6u) to ensure that the transistors may normally function as switches. Optionally, the channel width-to-length ratio of the first transistor M1 may be set to be 900u/6u, which may ensure the rapid transmission of the first data signal at the data write stage and reduce the delay of charging the first boost node Nbs1 at the data write stage. Optionally, the channel width-to-length ratios of the first transistor M1 and the second transistor M2 may be set to be 1300u/6u, which may further reduce the conduction resistance and increase the drive currents of the first driving transistor M01 and the second driving transistor M02.

The effect on the drive current after introducing the first boost module 21 in the present disclosure is described using simulation data hereinafter. The simulation is based on the following conditions, where the voltage of the first power signal terminal PVEE is approximately 0 V, the voltage of the second power signal terminal PVDD is approximately 20 V, the channel width-to-length ratio of the first driving transistor M01 is approximately 1300u/6u, the channel width-to-length ratio of the first transistor M1 is approximately 900u/6u, the channel width-to-length ratios of the remaining transistors are all approximately 30u/6u, the capacitance value of the first capacitor C1 corresponding to the first boost module 21 is approximately 7 pF, and the capacitance value of the capacitor corresponding to the first storage module is approximately 0.15 pF. By adjusting the voltage magnitude of the first data signal inputted from the data signal terminal Vdata, the drive current magnitude outputted to the light-emitting element D1 may also change accordingly, which is described in detail in table 1.

TABLE 1 the corresponding relationship between the voltage of the data signal terminal Vdata and the drive current

| Voltage of the data signal terminal Vdata (V) | Voltage of the first node N1 (V) | Drive current (mA) |
|---|---|---|
| 1 | 21 | 1.0 |
| 2 | 22.2 | 1.1 |
| 3 | 23 | 1.2 |
| 4 | 23.9 | 1.3 |
| 5 | 24.7 | 1.4 |
| 6 | 25.6 | 1.5 |

It can be seen from table 1 that the voltage value of the first data signal outputted from the data signal terminal Vdata may be adjusted, and the output current of the driving circuit 100 and the voltage value of the first data signal may be basically in a linear relationship. As the voltage value of the first data signal increases, the voltage of the first node N1 and the drive current may also increase. When the voltage value of the first data signal increases to 6 V, the drive current may reach 1.5 mA which is sufficient to drive the light-emitting element D1 to emit light.

Furthermore, the drive current may also be adjusted by modifying the width-to-length ratio of the first driving transistor M01. It can be obtained from simulation that when the width-to-length ratio of the first driving transistor M01 is 750u/6u, the drive current is approximately 0.2 mA; when the width-to-length ratio of the first driving transistor M01 is 1700u/6u, the drive current is approximately 0.4 mA; when the width-to-length ratio of the first driving transistor M01 is 3800u/6u, the drive current is approximately 1 mA; and when the width-to-length ratio of the first driving transistor M01 is 6000u/6u, the drive current is approximately 1.5 mA. It can be seen that the width-to-length ratio of the first driving transistor M01 is directly proportional to the drive current. The larger the width-to-length ratio is, the greater the corresponding output drive current is. In an actual application process, the drive current of the driving circuit 100 may be increased by simultaneously adjusting the voltage of the first data signal (range 0V~6V) of the data signal terminal Vdata and the channel width-to-length ratio of the first driving transistor M01. Therefore, the drive current of the driving circuit 100 may be effectively increased without changing the existing output capacity of the data signal terminal Vdata.

In one alternative embodiment of the present disclosure, the first driving transistor M01, the second driving transistor M02, the first transistor M1, the second transistor M2, the third transistor M3, the fourth transistor M4, and the fifth transistor M5 may all be amorphous silicon thin-film transistors.

For example, the first boost module 21 may be introduced in the driving circuit 100 provided by the present application, which may be used to increase the potential of the first boost node Nbs1 and the potential of the first node N1 at the light-emitting stage. Therefore, the first driving transistor M01 and other transistors in the present application may not need to use low temperature polysilicon transistors with relatively high electron mobility and relatively high cost, and transistors with lower electron mobility (e.g., amorphous silicon transistors) may also be suitable for the driving circuit 100 in the present application. Considering that the amorphous silicon thin-film transistors are manufactured by a simple and established manufacturing process with low cost, when all transistors in the driving circuit 100 are configured as amorphous silicon driving transistors, it may be advantageous for simplifying the manufacturing process of the entire driving circuit 100 while implementing reliable driving of the light-emitting element D1, and it may also be advantageous for reducing the manufacturing cost of the entire driving circuit 100.

In one optional embodiment of the present disclosure, the driving circuit 100 may be a backlight driving circuit 100, or the driving circuit 100 may be a pixel driving circuit 100.

For example, the driving circuit 100 provided in the above-mentioned embodiments of the present application may be applied to the backlight module of a liquid crystal display device 300. As the backlight driving circuit 100 of the backlight module, each driving circuit 100 may drive one or more light-emitting elements D1 accordingly. Since amorphous silicon driving transistors are used for all transistors in the backlight driving circuit 100, it may be advantageous for simplifying the manufacturing process of the entire driving circuit 100 while implementing reliable driving of the light-emitting element D1, and it may also be advantageous for reducing the manufacturing cost of the entire driving circuit 100. Similarly, the driving circuit 100 is applied to the pixel driving circuit 100 in the display device 300, and the light-emitting element may be used as the display pixel of the display device 300. Since amorphous silicon driving transistors are used for all transistors in the pixel driving circuit 100, it may be advantageous for simplifying the manufacturing process of the entire pixel driving circuit 100 while implementing reliable driving of the light-emitting element D1, and it may also be advantageous for reducing the manufacturing cost of the pixel driving circuit 100.

Figure 11:
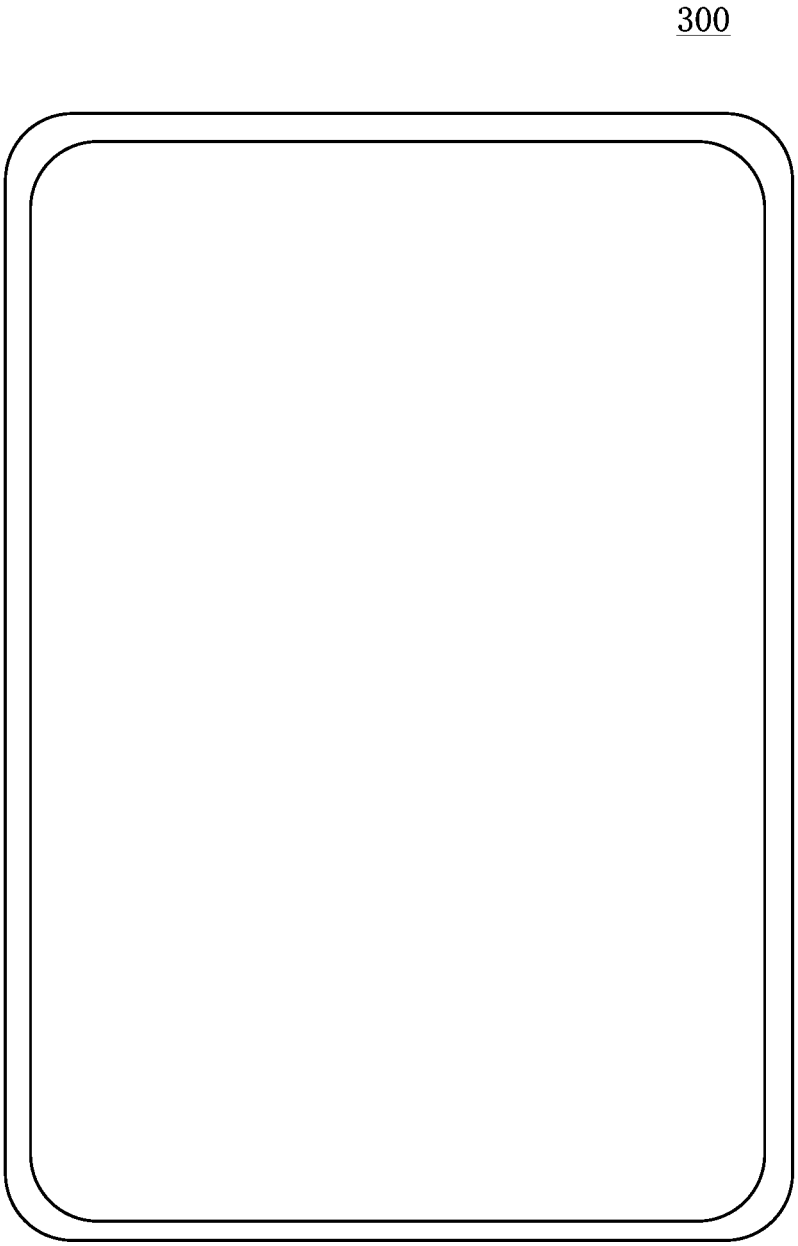
FIG. 11 illustrates a top view of a display device according to exemplary embodiments of the present disclosure.
Figure 12:
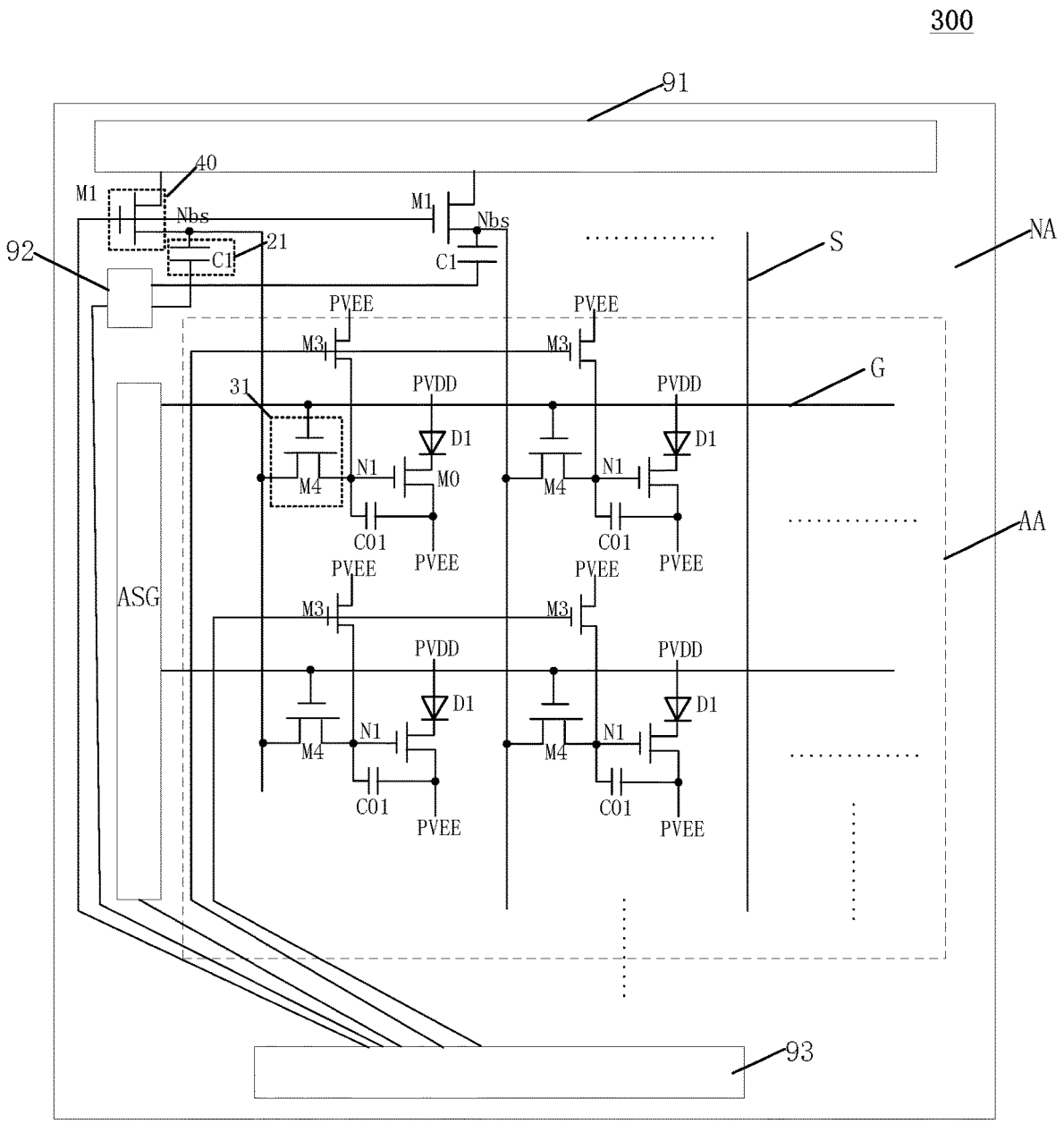
FIG. 12 illustrates a layout schematic of driving circuits on a display device.

Base on the same inventive concept, the present application also provides the display device 300. FIG. 11 illustrates a top view of the display device 300 according to exemplary embodiments of the present disclosure. FIG. 12 illustrates a layout schematic of the driving circuits on the display device. The display device 300 may include a display region AA and a non-display region NA surrounding the display region AA. The display device 300 may further include the driving circuits provided in the above-mentioned embodiments. The first boost module 21 and the data write module 40 may be in the non-display region NA, and the light-emitting elements D1, the first driving transistor M01, the first storage module 11, and the first light-emitting control module 31 may be in the display region AA. The light-emitting elements D1 may be arranged in an array in the display region AA, and one driving circuit 100 may correspond to at least one light-emitting element D1. It should be noted that only a portion of the driving circuits in the display device is shown in FIG. 12, and the display device may actually include a plurality of driving circuits, which are not all shown in the present application.

Optionally, the display device 300 provided in the present application may be the liquid crystal display device 300. The backlight driving circuit 100 in the liquid crystal display device 300 may use the driving circuit 100 provided by the present application, and the light-emitting element D1 may be used as the light source of the backlight driving circuit 100. In certain other embodiments of the present application, the driving circuit 100 provided by the present application may also be used as the pixel driving circuit 100 in the display device 300 provided by the present application. At this point, the light-emitting element D1 may be used as the pixel in the display device 300.

For example, referring to FIGS. 11-12, when the driving circuit 100 is applied to the display device 300, the first boost module 21 and the data write module 40 may be disposed in the non-display region AA, and other components such as the light-emitting element D1, the first driving transistor M01, the first storage module 11, and the first light-emitting control module 31 may be disposed in the display region AA. Due to the relatively large volumes of the first boost module 21 and the data write module 40, the space of the display region AA may not be occupied when the first boost module 21 and the data write module 40 are disposed in the non-display region AA, which may be beneficial for reducing the influence of the introduction of the first boost module 21 and the data write module 40 on the screen-to-body ratio of the display device 300. It should be noted that when the driving circuit 100 in the present application is applied to the display device 300, other technical effects of the display device 300 may refer to the technical effects of the driving circuit 100 in the above-mentioned embodiments, which may not be described by the present application in detail herein.

In one optional embodiment of the present disclosure, referring to FIG. 12, the display device 300 may further include a data drive module 91, a boost drive module 92, a drive chip 93, a plurality of data lines S which may be arranged along a first direction and extend along a second direction, and a plurality of gate lines G which may extend along the first direction and be arranged along the second direction, where the first direction intersects the second direction. At least a portion of the driving circuits 100 may share a same data write module 40, a same first boost module 21, and a same data line S.

The first terminal of the data write module 40 may be electrically connected to the data drive module 91 through the data signal terminal Vdata; the second terminal of the data write module 40 may be electrically connected to the data line S through the first boost node Nbs1; and the control terminal of the data write module 40 may be electrically connected to the drive chip 93. The first terminal of the first boost module 21 may be electrically connected to the boost drive module 92 through the boost signal terminal S1, and the second terminal of the first boost module 21 may be electrically connected to the data line S through the first boost node Nbs1. In the driving circuits 100 sharing the same data line S, the first terminal of each first light-emitting control module 31 may be electrically connected to the same data line S; the second terminal of each first light-emitting control module 31 may be electrically connected to the first node N1; and the control terminal of each first light-emitting control module 31 may be electrically connected to the gate line G.

For example, referring to FIG. 12, the display device 300 may include the plurality of gate lines G and the plurality of data lines S. Two adjacent gate lines G and two adjacent data lines S may cross to define a plurality of light-emitting regions. The light-emitting elements D1 corresponding to the same driving circuit 100 may be located in a same light-emitting region. It should be noted that the quantity of the light-emitting elements D1 corresponding to the same driving circuit 100 may be one or more. The control terminals of the first light-emitting control modules 31 of the driving circuits 100 corresponding to the light-emitting elements D1 in the same row may be electrically connected to the same gate line G. The gate line G may be electrically connected to a gate driving circuit ASG. At the light-emitting stage, the gate line G may control each first light-emitting control module 31 electrically connected to the gate line G to be in conduction, such that the voltage of the first boost node Nbs1 may be transmitted to the first node N1, and furthermore, the light-emitting elements D1 in the same row may emit light simultaneously. The driving circuits 100 corresponding to the light-emitting elements D1 in the same column may share the same data line S, the same first boost module 21, and the same data write module 40. That is, it is sufficient to introduce one first boost module 21, one data write module 40, and one data line S for the plurality of driving circuits 100 corresponding to the light-emitting elements D1 in the same column. When scanning the light-emitting elements D1 in a row, the data drive module 91 may control the data write module 40 to respectively transmit the first data signal to the first boost nodes Nbs1 of the first driving circuits 100 corresponding to the light-emitting elements D1 of the row. Next, the boost control module may transmit the boost signal to each boost module 21 to increase the voltages of the first boost nodes Nbs1 of the driving circuits 100 corresponding to the light-emitting elements D1 of the row. At the light-emitting stage, the drive chip 93 may control each first light-emitting control module 31 of the driving circuits 100 corresponding to the light-emitting elements D1 of the row to be in conduction, the potentials of the first boost nodes Nbs1 may be transmitted to the first nodes N1, such that the first driving transistors M01 in the row may generate the drive currents to drive the light-emitting elements D1 to emit light. Optionally, the boost drive module 92 in the present application may be integrated in the drive chip 93, or may be integrated in the gate driving circuit ASG.

In the display device 300 provided by the present application, it is not necessary to introduce a separate first boost module 21 and a separate data write module 40 for each driving circuit 40, but the plurality of driving circuits 100 may share the same first boost module 21 and the same data write module 40. In such way, by introducing a small quantity of the first boost modules 21 and the data write modules 40, the drive currents of all driving circuits 100 in the display device 300 may be increased; meanwhile, the small quantity of the first boost modules 21 and the data write modules 40 may not occupy substantial space in the non-display region NA, such that it may not affect the screen-to-body ratio of the display device 300.

Figure 13:
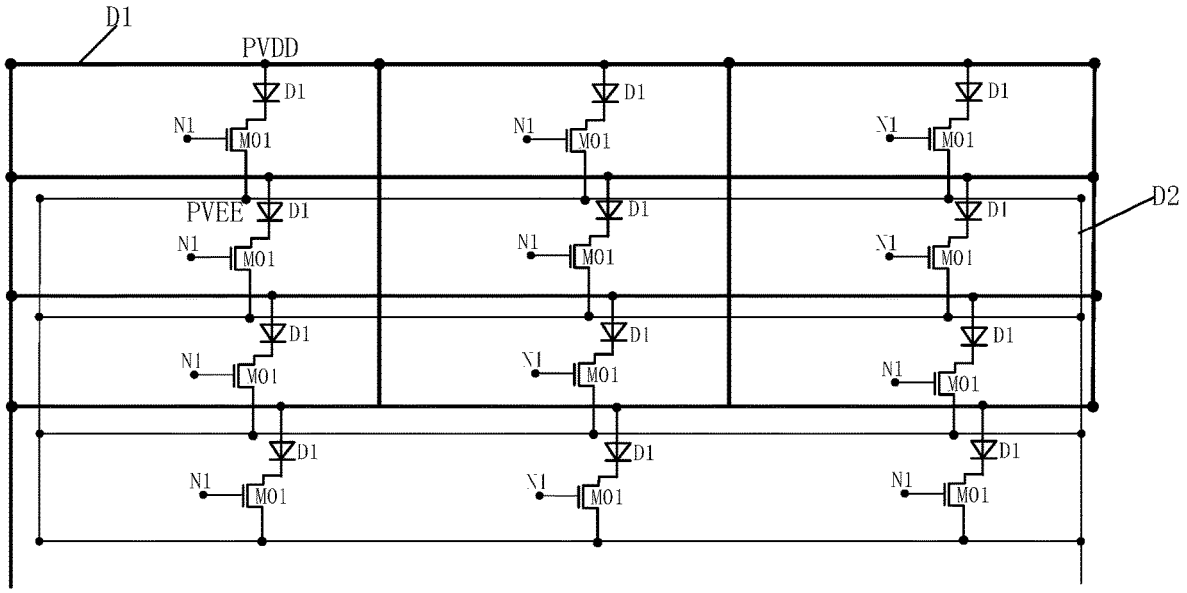
FIG. 13 illustrates a layout schematic of first power signal lines and second power signal lines on a display device.

In one optional embodiment of the present disclosure, FIG. 13 illustrates a layout schematic of the first power signal lines D1 and the second power signal lines D2 on the display device 300. The display device 300 may further include the first power signal lines D1 electrically connected to each other and the second power signal lines D2 electrically connected to each other. The first power signal line D1 and the second power signal line D2 may be electrically connected to the drive chip 93, respectively. The first electrode of the first driving transistor M01 may be electrically connected to the first power signal line D1 through the first power signal terminal PVEE. The first electrode of the light-emitting element D1 may be electrically connected to the second electrode of the first driving transistor M01, and the second electrode of the light-emitting element D1 may be electrically connected to the second power signal line D2. It should be noted that the first power signal line D1 and the second power signal line D2 are differentiated by the differences in line thicknesses in FIG. 13, which may not represent the actual sizes of the first power signal line D1 and the second power signal line D2. Furthermore, only a portion of the first power signal lines D1 and the second power signal lines D2 in the display device is illustrated in FIG. 13, which may not limit the quantities of the first power signal lines and the second power signal lines.

For example, FIG. 13 illustrates the layout schematic of the first power signal lines D1 and the second power signal lines D2 on the display device 300. In the display device 300, the first power signal lines D1 may be electrically connected to each other, and the second power signal lines D2 may be electrically connected to each other. The first power signal terminals PVEE in the driving circuit 100 may be electrically connected to the first power signal lines D1 respectively; and the second power signal terminals PVDD in the driving circuit 100 may be electrically connected to the second power signal lines D2 respectively. The drive chip 93 may provide first power signals and second power signals to the first power signal terminals PVEE and the second power signal terminals PVDD through the first power signal lines D1 and the second power signal lines D2, respectively. Optionally, the first power signal lines D1 and the second power signal lines D2 may form a grid structure in the display device 300. Therefore, it is beneficial for reducing the impedance of the first power signal lines D1 and the second power signal lines D2, and reducing the difference between the first power signals or the second power signals received by each driving circuit 100 from the side adjacent to the drive chip 93 to the side away from the drive chip 93, thereby improving the display brightness uniformity of the display device 300.

Figure 14:
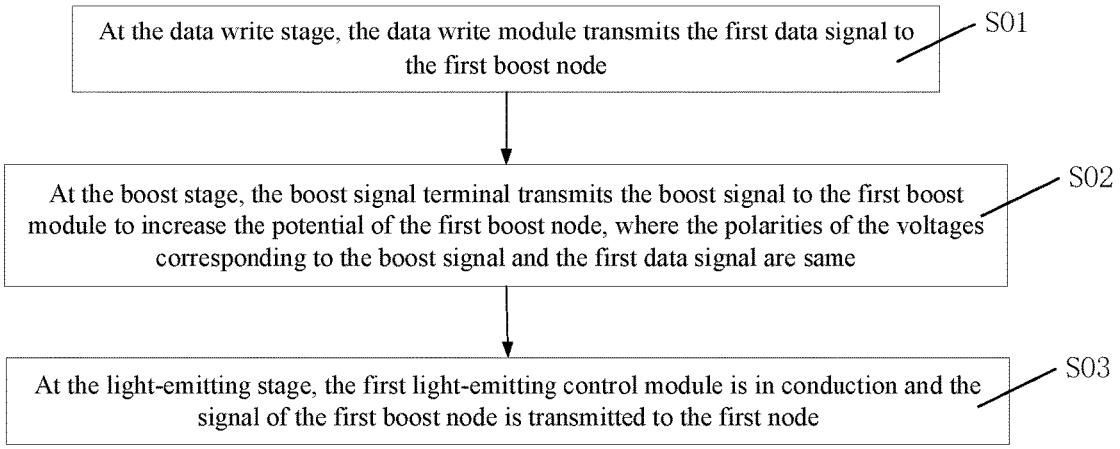
FIG. 14 illustrates a flow chart of a drive method of a driving circuit according to exemplary embodiments of the present disclosure.
Figure 15:
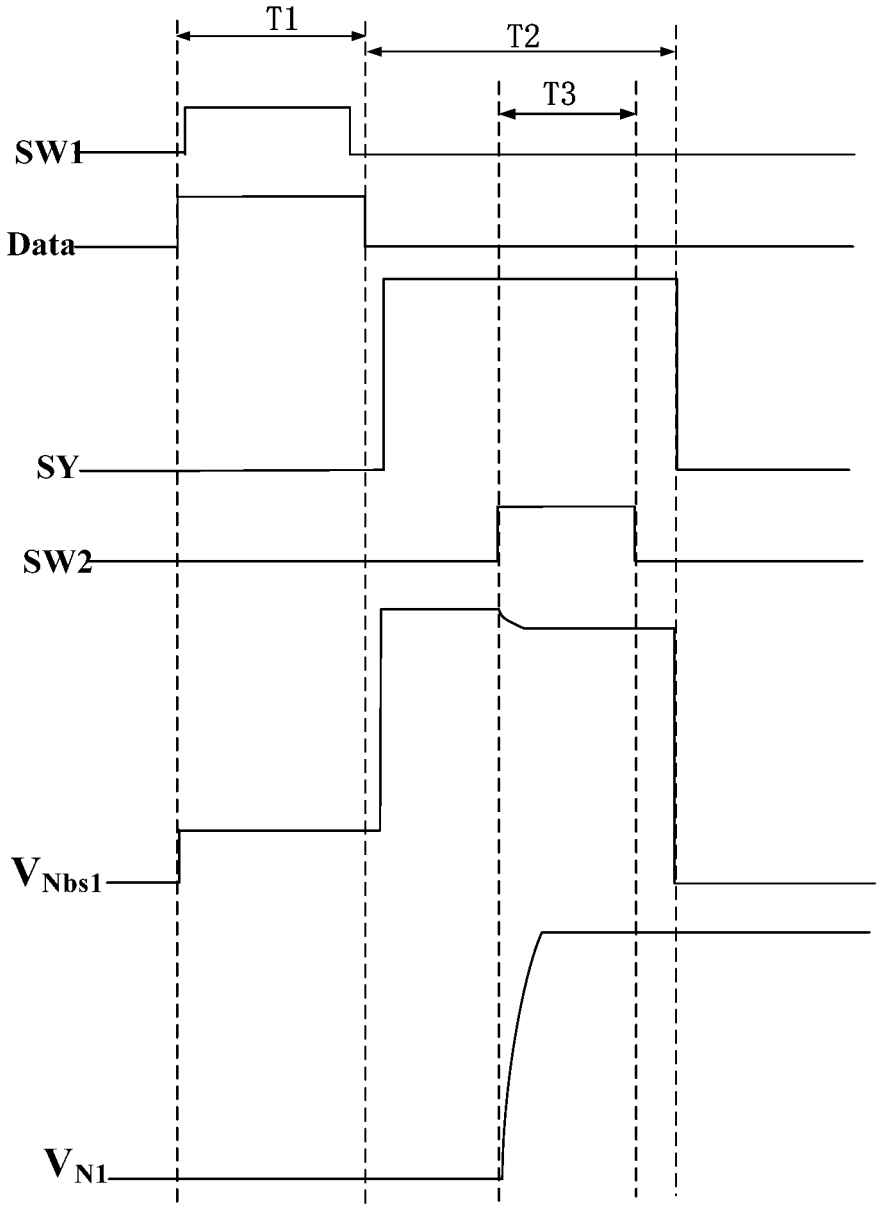
FIG. 15 illustrates a drive sequence diagram corresponding to the drive method in FIG. 14.

Based on the same inventive concept, the present application further provides a drive method of any one of the driving circuits 100 in the above-mentioned embodiments. FIG. 14 illustrates a flow chart of a drive method of the driving circuit 100 according to exemplary embodiments of the present disclosure. FIG. 15 illustrates a drive sequence diagram corresponding to the drive method in FIG. 14. Referring to FIG. 2, FIG. 14, and FIG. 15, the driving circuit 100 may include the data write stage, the boost stage, and the light-emitting stage. In the same frame, the data write stage may be executed before the boost stage, and the light-emitting may be executed after the boost stage, where:

at step S01, the data write module 40 may transmit the first data signal to the first boost node Nbs1 at a data write stage T1;

at step S02, the boost signal terminal S1 may transmit the boost signal to the first boost module 21 to increase the potential of the first boost node Nbs1 at a boost stage T2, where the polarities of the voltages corresponding to the boost signal and the first data signal may be same; and at step S03, the first light-emitting control module 31 may be in conduction and the signal of the first boost node Nbs1 may be transmitted to the first node N1 at a light-emitting stage T3.

It should be noted that the light-emitting stage T3 is executed after the boost stage T2 mentioned above, which may refer to that the starting position of the light-emitting stage T3 may be after the starting position of the boost stage T2, and may not refer to that the light-emitting stage T3 is entered after the boost stage T2 has been executed; and the light-emitting stage T3 may also overlap the boost stage T2.

For example, in the drive sequence diagram provided in FIG. 15, SW1 represents the control signal inputted to the control terminal of the data write module 40; Data represents the first data signal inputted to the data write module 40; SW2 represents the control signal inputted to the first light-emitting control module 31; SY represents the boost signal inputted to the first boost module 21; $V_{Nbs1}$ represents the signal of the first boost node Nbs1; and $V_{N1}$ represents the signal of the first node N1. Referring to FIG. 2 and FIG. 15, at the data write stage T1, a high-level signal may be inputted to the control terminal of the data write module 40 to enable the data write module 40 to be in conduction, and the first data signal may be transmitted to the first boost node Nbs1 through the data write module 40; at the boost stage T2, the boost signal may be inputted to the first boost module 21 to increase the potential of the first boost node Nbs1; and at the light-emitting stage T3, a high-level signal may be inputted to the control terminal of the first light-emitting control module 31 to enable the first light-emitting control module 31 to be in conduction, and the signal of the first boost node Nbs1 may be transmitted to the first node N1. Optionally, the data write module 40 may be turned on after the first data signal enters and turned off before the first data signal ends, thereby writing the first data signal into the first boost node Nbs1. The boost signal may be turned on after the first data signal is written, and the first light-emitting control module 31 may be turned on after the boost signal is stabilized and turned off before the boost signal ends, thereby writing the boosted signal to the first node N1. In such way, without changing the voltage corresponding to the first data signal provided by the data write module 40, the first boost module 21 may be introduced to increase the drive current of the driving circuit 100. Even if amorphous silicon driving transistors with low cost are used as the first driving transistors M01 in the driving circuit 100 provided by the present application, the drive requirement may still be satisfied. Therefore, it may be advantageous for simplifying the manufacturing process and reducing the manufacturing cost while increasing the drive current.

In one optional embodiment of the present disclosure, referring to FIG. 7, the driving circuit 100 may further include the second driving transistor M02, the second storage module 12, the second boost module 22, and the second light-emitting control module 32. At the light-emitting stage T3, the first light-emitting control module 31 and the second light-emitting control module 32 may be in conduction simultaneously, and the first driving transistor M01 and the second driving transistor M02 may respectively generate the drive currents which act on the second node N2, thereby driving the light-emitting element D1 to emit light.

For example, referring to FIG. 7 and FIG. 15, at the data write stage T1, while the data write module 40 transmits the first data signal to the first boost node Nbs1, the data write module 40 also transmits the first data signal to the second boost node Nbs2. The first boost module 21 and the second boost module 22 may be connected to the same boost signal terminal S1. At the boost state T2, the boost signal terminal S1 may transmit the boost signals to the first boost module 21 and the second boost module 22 simultaneously, thereby increasing both potentials of the first boost node Nbs1 and the second boost node Nbs2. At the light-emitting stage T3, both the first light-emitting control module 31 and the second light-emitting control module 32 may be in conduction, the signal of the first boost node Nbs1 may be transmitted to the first node N1, and the signal of the second boost node Nbs2 may be transmitted to the second node N2. In such way, both the first driving transistor M01 and the second driving transistor M02 may generate the drive currents, thereby jointly driving the light-emitting element D1 to emit light. Two boost modules and two driving transistors may be introduced in the driving circuit 100 of the present application. The introduction of the first boost module 21 and the second boost module 22 may effectively increase the potentials of the gate electrodes of the first driving transistor M01 and the second driving transistor M02, and further increase the drive currents generated by the first driving transistor M01 and the second driving transistor M02. Moreover, the drive currents generated by the first driving transistor M01 and the second driving transistor M02 may be used to jointly drive the light-emitting element D1, which may further increase the magnitude of the drive current. Therefore, even if amorphous silicon driving transistors with low cost are used as the first driving transistors M01 and the second driving transistors M02 in the driving circuit 100 provided by the present application, the drive currents may be effectively increased, and the drive requirement of the light-emitting element D1 may be satisfied while simplifying the manufacturing process and reducing the manufacturing cost.

Figure 16:
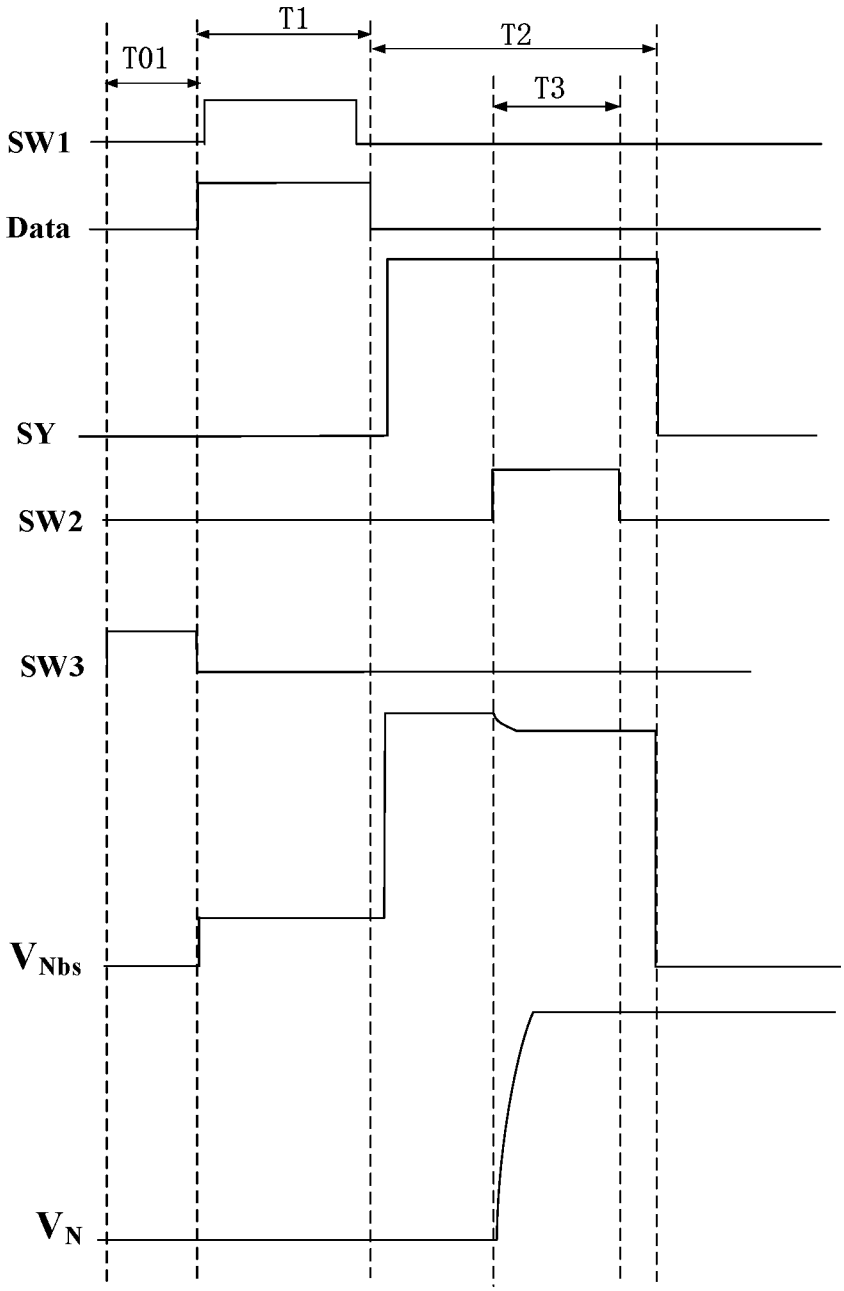
FIG. 16 illustrates a drive sequence diagram corresponding to the driving circuit in FIG. 10.

In one optional embodiment of the present disclosure, referring to FIG. 10 and FIG. 16, FIG. 16 illustrates a drive sequence diagram corresponding to the driving circuit 100 in FIG. 10. The driving circuit 100 may further include the first reset module 51. The control terminal of the first reset module 51 may be connected to the first reset control terminal S3, the first terminal of the first reset module 51 may be electrically connected to the first boost node Nbs1, and the second terminal of the first reset module 51 may be electrically connected to the first power signal terminal PVEE. The drive method may further include a first reset stage T01. In the same frame, the first reset stage T01 may be executed before the data write stage T1. At the first reset stage T01, the first reset control terminal S3 may transmit the control signal to the first reset module 51 to enable the first reset module 51 to be in conduction; and the first power signal terminal PVEE may transmit a first level signal to the first boost node Nbs1.

It should be noted that the first reset stage T01 is executed before the data write stage T1 mentioned above, which may refer to that the starting position of the first reset stage T01 is before the starting position of the data write stage T1, and the ending positions of the first reset stage T01 and the data write stage T1 may not be limited according to the embodiments of the present disclosure.

Referring to FIG. 10 and FIG. 16, the first reset module 51 may be introduced in the driving circuit 100 of the present application to reset the first boost node Nbs1. In FIG. 16, SW3 represents the control signal inputted to the control terminal of the first reset module 51, $V_{Nbs}$ represents the signal of the first boost node Nbs1 and the second boost node Nbs2; and $V_N$ represents the signal of the first node N1 and the second node N2. Before the data write stage T1, the first boost node Nbs1 may be reset first. That is, a high-level signal may be transmitted to the control terminal of the first reset module 51 to enable the first reset module 51 to be in conduction, and the signal of the first power signal terminal PVEE may be transmitted to the first boost node Nbs1 to reset the first boost node Nbs1. Then, the data write stage T1, the boost stage T2, and the light-emitting stage T3 may be executed. In a frame time, the data write module 40 may write the data signal to the first boost node Nbs1 at the data write stage T1; at the boost stage T2, the first boost module 21 may increase the potential of the first boost node Nbs1; and at the light-emitting stage T3, the signal of the first boost node Nbs1 may be transmitted to the first node N1, such that the first driving transistor M01 may generate a relatively large drive current to drive the light-emitting element D1 to emit light. In a next frame, before writing the data signal to the first boost node Nbs1, the first reset module 51 may first be used to reset the first boost node Nbs1, such that before the data write module 40 transmits the data signal to the first boost node Nbs1, the potentials of the first boost node Nbs1 may be same in each frame time, which is beneficial for improving the accuracy of data signal transmission in the driving circuit 100.

The drive method of the present application is described with reference to FIG. 10 and FIG. 16 hereinafter.

At the first reset stage T01, the high-level signal may be transmitted to the control terminal of the first reset module 51 to enable the first reset module 51 to be in conduction, and the signal of the first power signal terminal PVEE may be transmitted to the first boost node Nbs1 through the first reset module 51.

At the data write stage T1, the high-level signal may be transmitted to the data write module 40 to enable the data write module 40 to be in conduction, and the first data signal may be transmitted to the first boost node Nbs1 and the second boost node Nbs2 through the data write module 40.

At the boost stage T2, the boost signal terminal S1 may transmit the boost signals to the first boost module 21 and the second boost module 22 respectively, thereby increasing the potentials of the first boost node Nbs1 and the second boost node Nbs2.

At the light-emitting stage T3, the high-level signal may be transmitted to the control terminals of the first light-emitting control module 31 and the second light-emitting control module 32, such that the first light-emitting control module 31 and the second light-emitting control module 32 may be in conduction simultaneously. The signal of the first boost node Nbs1 may be transmitted to the first node N1, the signal of the second boost node Nbs2 may be transmitted to the second node N2, and the first driving transistor M01 and the second driving transistor M02 may simultaneously generate the drive currents to drive the light-emitting element D1 to emit light.

Figure 17:
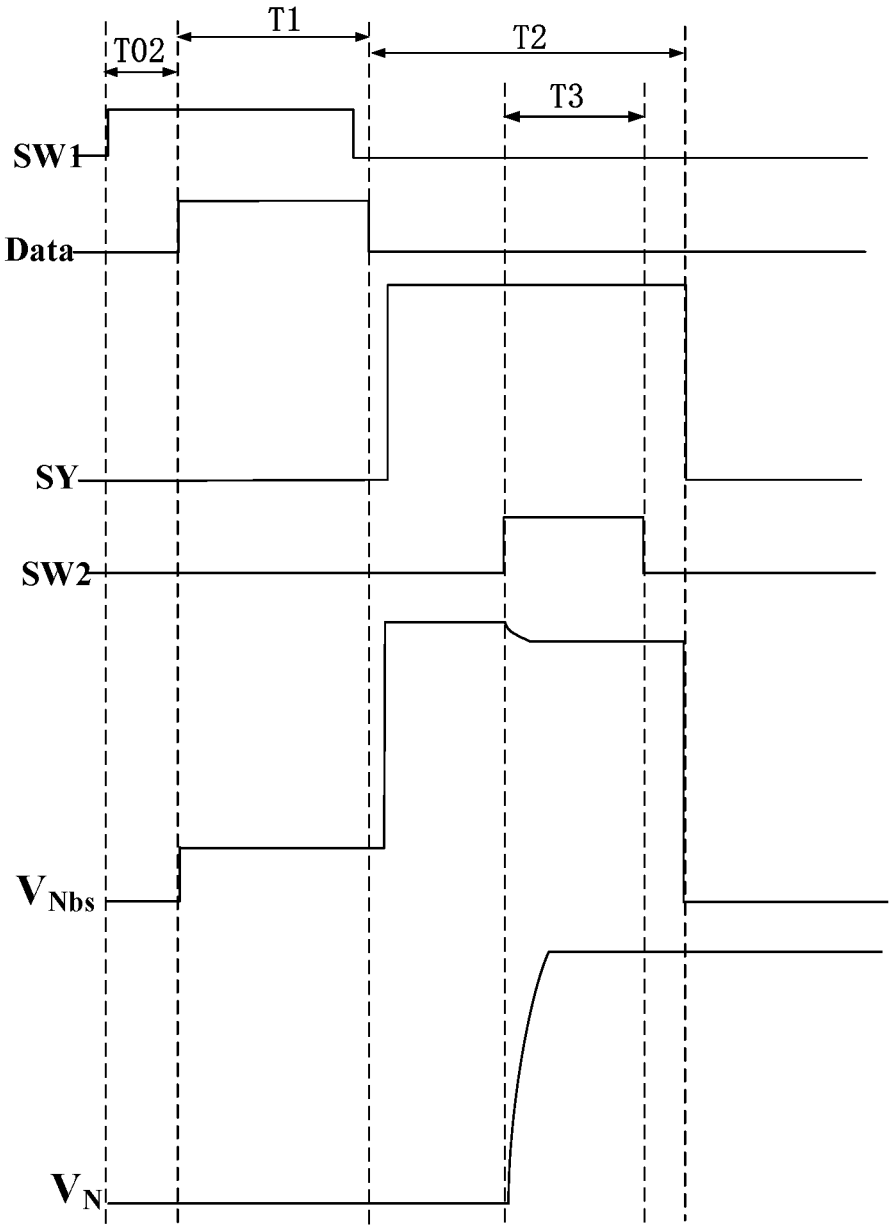
FIG. 17 illustrates a drive sequence diagram corresponding to the driving circuit in FIG. 9.

The above-mentioned embodiments show the solution for resetting the boost node through the first reset module 51. In one optional embodiment of the present disclosure, the first reset module 51 may not be introduced, and the boost node may be reset using the existing structure. Referring to FIG. 9 and FIG. 17, FIG. 17 illustrates a drive sequence diagram corresponding to the driving circuit 100 in FIG. 9, and the drive method may further include a first reset stage T02. In a same frame, the first reset stage T02 may be executed before the data write stage T1; at the first reset stage T02, the data write module 40 may be in conduction, and the data write module 40 may transmit the second data signal to the first boost node Nbs1, where the polarities of the voltages corresponding to the second data signal and the first data signal may be opposite.

In the circuit shown in FIG. 9, the resetting of the first boost node Nbs1 may be implemented without introducing the first reset module 51, which is beneficial for simplifying the structure of the driving circuit 100. For example, the working process shown in FIG. 9 is described through the drive sequence diagram shown in FIG. 17 hereinafter.

At the first reset stage T02, the high-level signal may be transmitted to the control terminal of the data write module 40 to enable the data write module 40 to be in conduction; and the data signal terminal Vdata may transmit the second data signal to the first boost node Nbs1 through the data write module 40, and the second data signal may be used to reset the first boost node Nbs1 and the second boost node Nbs2. Optionally, the second data signal may be a low-level signal, such as a ground signal.

At the data write stage T1, the data signal terminal Vdata may transmit the first data signal to the first boost node Nbs1 and the second boost Nbs2 through the data write module 40. Optionally, the first data signal may be a high-level signal, and the polarities of the voltages corresponding to the second data signal and the first data signal may be opposite.

At the boost stage T2, the boost signal terminal S1 may transmit the boost signals to the first boost module 21 and the second boost module 22 respectively, thereby increasing the potentials of the first boost node Nbs1 and the second boost node Nbs2.

At the light-emitting stage T3, the high-level signal may be transmitted to the control terminals of the first light-emitting control module 31 and the second light-emitting control module 32, such that the first light-emitting control module 31 and the second light-emitting control module 32 may be in conduction simultaneously. The signal of the first boost node Nbs1 may be transmitted to the first node N1, the signal of the second boost node Nbs2 may be transmitted to the second node N2, and the first driving transistor M01 and the second driving transistor M02 may simultaneously generate the drive currents to drive the light-emitting element D1 to emit light.

In one optional embodiment of the present disclosure, referring to FIG. 9, the driving circuit 100 may further include the second reset module 52. The control terminal of the second reset module 52 may be connected to the second reset control terminal, the first terminal of the second reset module 52 may be electrically connected to the first node N1, and the second terminal of the second reset module 52 may be electrically connected to the first power signal terminal PVEE.

Figure 18:
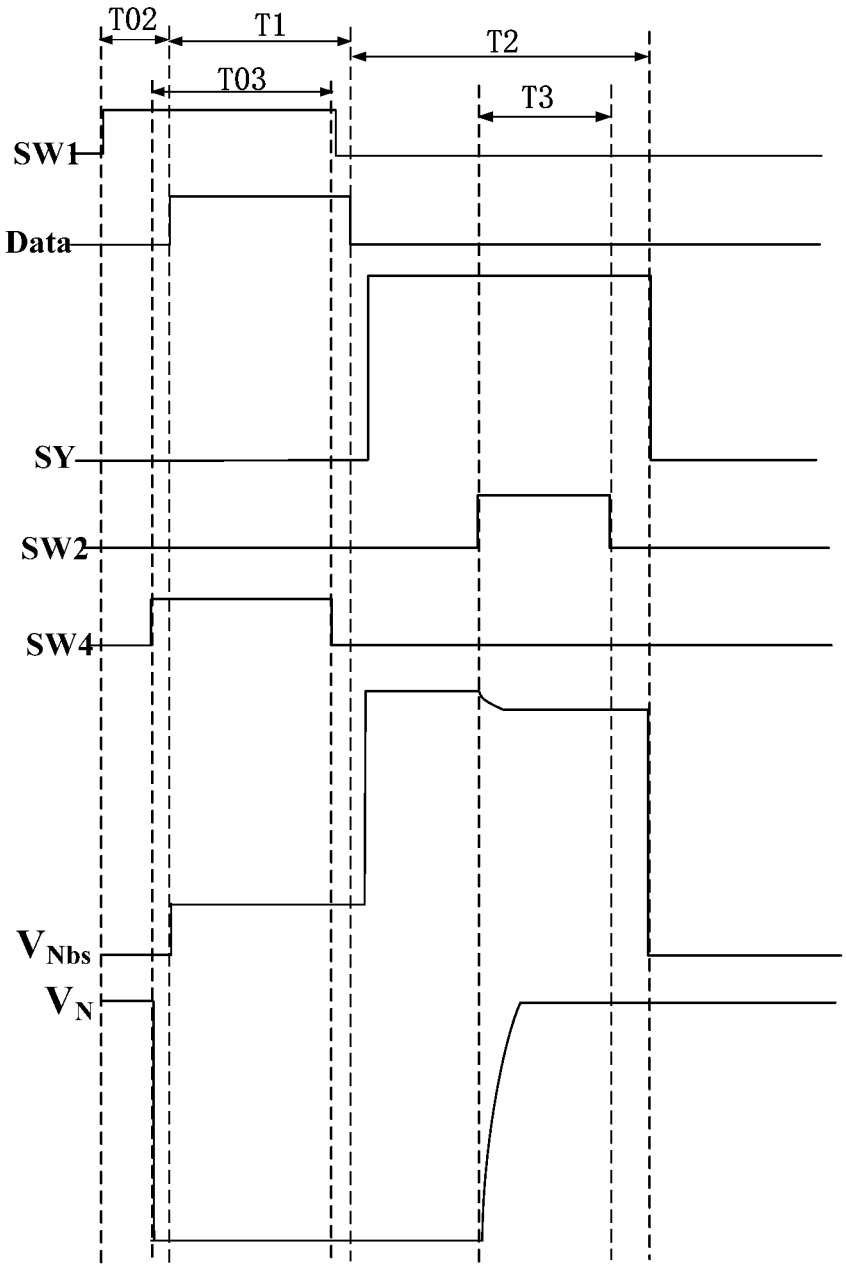
FIG. 18 illustrates another drive sequence diagram corresponding to the driving circuit in FIG. 9.

Referring to FIG. 18, FIG. 18 illustrates another drive sequence diagram corresponding to the driving circuit 100 in FIG. 9, and the drive method may further include a second reset stage T03. In a same frame, the second reset stage T03 may be executed before the boost stage T2; at the second reset stage T03, the second reset control terminal may transmit the control signal to the second reset module 52 to enable the second reset module 52 to be in conduction, and the first power signal terminal PVEE may transmit a second level signal to the first node N1.

At the light-emitting stage T3 in a frame time, the first light-emitting control module 31 may be in conduction, and the signal of the first boost node Nbs1 may be transmitted to the first node N1, such that the driving transistor may generate a relatively large current to drive the light-emitting element D1 to emit light. In a next frame, before executing the light-emitting stage T3, the second reset module 52 in the present application may be used to reset the first node N1. Therefore, when the first boost node Nbs1 transmits the signal to the first node N1 at the light-emitting stage T3, the potentials of the first node N1 may be same in each frame time, which is beneficial for improving the data accuracy of the first node N1, thereby enabling the light-emitting element D1 to emit light according to expected brightness.

For example, the working process of the driving circuit 100 after introducing the second reset module 52 in FIG. 9 is described with reference to the time sequence diagram shown in FIG. 18, where SW4 represents the control signal transmitted to the control terminal of the second reset module.

At the first reset stage T02, the high-level signal may be transmitted to the control terminal of the data write module 40 to enable the data write module 40 to be in conduction; and the data signal terminal Vdata may transmit the second data signal to the first boost node Nbs1 through the data write module 40, and the second data signal may be used to reset the first boost node Nbs1 and the second boost node Nbs2. Optionally, the second data signal may be a low-level signal, such as a ground signal.

At the data write stage T1, the data signal terminal Vdata may transmit the first data signal to the first boost node Nbs1 and the second boost Nbs2 through the data write module 40. Optionally, the first data signal may be a high-level signal, and the polarities of the voltages corresponding to the second data signal and the first data signal may be opposite.

At the second reset stage T03, the second reset control terminal S4 may transmit the high-level signal to the second reset module 52 to enable the second reset module 52 to be in conduction, and the first power signal terminal PVEE may transmit the second level signal to the first node N1 to reset the first node N1.

At the boost stage T2, the boost signal terminal S1 may transmit the boost signals to the first boost module 21 and the second boost module 22 respectively, thereby increasing the potentials of the first boost node Nbs1 and the second boost node Nbs2.

At the light-emitting stage T3, the high-level signal may be transmitted to the control terminals of the first light-emitting control module 31 and the second light-emitting control module 32, such that the first light-emitting control module 31 and the second light-emitting control module 32 may be in conduction simultaneously. The signal of the first boost node Nbs1 may be transmitted to the first node N1, the signal of the second boost node Nbs2 may be transmitted to the second node N2, and the first driving transistor M01 and the second driving transistor M02 may simultaneously generate the drive currents to drive the light-emitting element D1 to emit light.

It should be noted that the second reset stage T03 introduced in the present application, that is, the stage of resetting the first node N1, may be executed before the light-emitting stage T3. The sequence relationship between the second reset stage T03, the first reset stage T01, and the data write stage T1 may not be limited according to the embodiment of the present application. The time sequence diagram shown in FIG. 18 illustrates the solution where the starting position of the second reset stage T03 may be executed after the starting position of the first reset stage T02 and before the starting position of the data write stage T1. The second reset stage T03 and other stages may be executed by overlapping with each other in the above-mentioned solution, which may be beneficial for reducing the length corresponding to one frame time and improving the refresh frequency of the display device. Obviously, in certain other embodiments of the present application, the second reset stage T03 may also be executed simultaneously with the first reset stage T02, or executed before the first reset phase T02, which may not be shown one by one in the present application.

From the above-mentioned embodiments, it can be seen that the driving circuit, the drive method, and the display device provided by the present disclosure may achieve at least the following beneficial effects.

In the driving circuit and its drive method of the present disclosure, the first boost module and the first boost node may be introduced in the driving circuit. In the same frame, at the data write stage, the data write module may transmit the first data signal to the first boost node; at the boost stage, the first boost module may receive the boost signal from the boost signal terminal to increase the potential of the first boost node, where, in particular, the polarities of the voltages corresponding to the boost signal and the first data signal may be same; and at the light-emitting stage, the first light-emitting control module between the first boost node and the electrode gate of the first driving transistor may be in conduction, and the signal of the first boost node may be transmitted to the first node. At this point, the potential of the first node may be increased compared with the potential when the first boost module is not introduced. The difference between the voltage of the first node and the threshold voltage of the first driving transistor is proportional to the magnitude of the drive current. In such way, when the potential of the first node of the first driving transistor increases, the difference between the voltage of the first node and the threshold voltage of the first driving transistor may become greater, thereby making the drive current greater. Therefore, without changing the voltage corresponding to the first data signal provided by the data write module, the first boost module may be introduced to increase the drive current of the driving circuit. Even if the amorphous silicon transistor with low electron mobility and low cost is used as the first driving transistor in the driving circuit provided by the present application, the drive requirement may also be satisfied, thereby simplifying the manufacturing process and reducing the manufacturing cost while increasing the drive current. When the driving circuit provided by the present application is applied to the display device, the driving circuit may be embodied as the pixel driving circuit in the display device and also be embodied as the backlight driving circuit in the display device. When the driving circuit provided by the present application is used as the pixel driving circuit or the backlight driving circuit of the display device, it may not only beneficial for increasing the drive current of the display device, but also reducing the manufacturing cost of the display device.

Although certain embodiments of the present disclosure have been described in detail through examples, those skilled in the art should understand that the above-mentioned examples are merely for illustration, not for limiting the scope of the present disclosure. Those skilled in the art should understand that the above-mentioned embodiments may be modified without departing from the scope and spirit of the present disclosure, and the scope of the disclosure may be defined by the appended claims.

What is claimed is:

1. A display device, comprising:

a display region and a non-display region surrounding the display region, wherein the display device includes a plurality of driving circuits, each comprising:

a first power signal terminal and a second power signal terminal;

a first driving transistor, wherein a gate electrode of the first driving transistor is connected to a first node, and a first electrode of the first driving transistor is connected to the first power signal terminal;

a light-emitting element, connected in series between a second electrode of the first driving transistor and the second power signal terminal;

a first storage module, wherein a first terminal of the first storage module is connected to a fixed voltage signal, and a second terminal of the first storage module is electrically connected to the first node;

a first boost module, wherein a first terminal of the first boost module is connected to a boost signal terminal, and a second terminal of the first boost module is electrically connected to a first boost node;

a first light-emitting control module, connected in series between the first node and the first boost node; and a data write module, wherein a control terminal of the data write module is connected to a data write control terminal, a first terminal of the data write module is connected to a data signal terminal, and a second terminal of the data write module is electrically connected to the first boost node, wherein:

the driving circuit includes a data write stage, a boost stage, and a light-emitting stage in a same frame, wherein:

at the data write stage, the data write module transmits a first data signal to the first boost node;

at the boost stage, the boost signal terminal transmits a boost signal to the first boost module to increase a potential of the first boost node, wherein polarities of voltages corresponding to the boost signal and the first data signal are same; and at the light-emitting stage, the first light-emitting control module is in conduction, and a signal of the first boost node is transmitted to the first node;

wherein the first boost module and the data write module are in the non-display region; the light-emitting element, the first driving transistor, the first storage module, and the first light-emitting control module are in the display region; light-emitting elements are arranged in an array in the display region; and one driving circuit corresponds to at least one light-emitting element.

2. The display device according to claim 1, further including:

a data drive module, a boost drive module, a drive chip, a plurality of data lines which is arranged along a first direction and extends along a second direction, and a plurality of gate lines which extends along the first direction and is arranged along the second direction, wherein:

the first direction intersects the second direction, and at least a portion of the plurality of driving circuits shares a same data write module, a same first boost module, and a same data line;

the first terminal of the data write module is electrically connected to the data drive module through the data signal terminal, the second terminal of the data write module is electrically connected to a data line through the first boost node, and the control terminal of the data write module is electrically connected to the drive chip;

the first terminal of the first boost module is electrically connected to the boost drive module through the boost signal terminal, and the second terminal of the first boost module is electrically connected to the data line through the first boost node; and in the driving circuits sharing the same data line, a first terminal of each first light-emitting control module is electrically connected to the same data line, and a second terminal of each first light-emitting control module is connected to the first node, and a control terminal of each first light-emitting control module is electrically connected to a gate line.

3. The display device according to claim 2, further including:

first power signal lines electrically connected to each other and second power signal lines electrically connected to each other, wherein a first power signal line and a second power signal line are electrically connected to the drive chip, respectively; and the first electrode of the first driving transistor is electrically connected to the first power signal line through the first power signal terminal; and a first electrode of the light-emitting element is electrically connected to the second electrode of the first driving transistor, and a second electrode of the light-emitting element is electrically connected to the second power signal line.

4. A drive method of a driving circuit, the driving circuit including: a first power signal terminal and a second power signal terminal; a first driving transistor, wherein a gate electrode of the first driving transistor is connected to a first node, and a first electrode of the first driving transistor is connected to the first power signal terminal; a light-emitting element, connected in series between a second electrode of the first driving transistor and the second power signal terminal; a first storage module, wherein a first terminal of the first storage module is connected to a fixed voltage signal, and a second terminal of the first storage module is electrically connected to the first node; a first boost module, wherein a first terminal of the first boost module is connected to a boost signal terminal, and a second terminal of the first boost module is electrically connected to a first boost node; a first light-emitting control module, connected in series between the first node and the first boost node; and a data write module, wherein a control terminal of the data write module is connected to a data write control terminal, a first terminal of the data write module is connected to a data signal terminal, and a second terminal of the data write module is electrically connected to the first boost node;

the method comprising:

a data write stage, a boost stage, and a light-emitting stage, wherein in a same frame, the data write stage is executed before the boost stage, and the light-emitting is executed after the boost stage, wherein:

at the data write stage, the data write module transmits a first data signal to the first boost node;

at the boost stage, the boost signal terminal transmits a boost signal to the first boost module to increase a potential of the first boost node, wherein polarities of voltages corresponding to the boost signal and the first data signal are same; and at the light-emitting stage, the first light-emitting control module is in conduction, and a signal of the first boost node is transmitted to the first node.

5. The drive method according to claim 4, wherein:

the driving circuit further includes a second driving transistor, a second storage module, a second boost module, and a second light-emitting control module; and at the light-emitting stage, the first light-emitting control module and the second light-emitting control module are simultaneously in conduction, and the first driving transistor and the second driving transistor respectively generate drive currents which act on a second node, thereby driving the light-emitting element to emit light.

6. The drive method according to claim 4, wherein:

the driving circuit further includes a first reset module, wherein a control terminal of the first reset module is connected to a first reset control terminal, a first terminal of the first reset module is electrically connected to the first boost node, and a second terminal of the first reset module is electrically connected to the first power signal terminal; and the drive method further includes a first reset stage, wherein in the same frame, the first reset stage is executed before the data write stage; at the first reset stage, the first reset control terminal transmits a control signal to the first reset module, thereby enabling the first reset module to be in conduction, and the first power signal terminal transmits a first level signal to the first boost node.

7. The drive method according to claim 4, further including:

a first reset stage, wherein in the same frame, the first reset stage is executed before the data write stage; and at the first reset stage, the data write module is in conduction and transmits a second data signal to the first boost node, wherein polarities of voltages corresponding to the second data signal and the first data signal are opposite to each other.

8. The drive method according to claim 4, wherein:

the driving circuit further includes a second reset module, wherein a control terminal of the second reset module is connected to a second reset control terminal, a first terminal of the second reset module is electrically connected to the first node, and a second terminal of the second reset module is electrically connected to the first power signal terminal; and the drive method further includes a second reset stage, wherein in the same frame, the second reset stage is executed before the boost stage; at the second reset stage, the second reset control terminal transmits a control signal to the second reset module, thereby enabling the second reset module to be in conduction, and the first power signal terminal transmits a second level signal to the first node.

9. A driving circuit, comprising:

a first power signal terminal and a second power signal terminal;

a first driving transistor, wherein a gate electrode of the first driving transistor is connected to a first node, and a first electrode of the first driving transistor is connected to the first power signal terminal;

a light-emitting element, connected in series between a second electrode of the first driving transistor and the second power signal terminal;

a first storage module, wherein a first terminal of the first storage module is connected to a fixed voltage signal, and a second terminal of the first storage module is electrically connected to the first node;

a first boost module, wherein a first terminal of the first boost module is connected to a boost signal terminal, and a second terminal of the first boost module is electrically connected to a first boost node;

a first light-emitting control module, connected in series between the first node and the first boost node; and a data write module, wherein a control terminal of the data write module is connected to a data write control terminal, a first terminal of the data write module is connected to a data signal terminal, and a second terminal of the data write module is electrically connected to the first boost node, wherein:

the driving circuit includes a data write stage, a boost stage, and a light-emitting stage in a same frame, wherein:

at the data write stage, the data write module transmits a first data signal to the first boost node;

at the boost stage, the boost signal terminal transmits a boost signal to the first boost module to increase a potential of the first boost node, wherein polarities of voltages corresponding to the boost signal and the first data signal are same; and at the light-emitting stage, the first light-emitting control module is in conduction, and a signal of the first boost node is transmitted to the first node.

10. The driving circuit according to claim 1, wherein:

the first boost module includes a first capacitor, wherein a first electrode of the first capacitor is configured as the first terminal of the first boost module, and a second electrode of the first capacitor is configured as the second terminal of the first boost module.

11. The driving circuit according to claim 1, further including:

a first reset module, wherein a control terminal of the first reset module is connected to a first reset control terminal, a first terminal of the first reset module is electrically connected to the first boost node, and a second terminal of the first reset module is electrically connected to the first power signal terminal.

12. The driving circuit according to claim 11, further including:

a second reset module, wherein a control terminal of the second reset module is connected to a second reset control terminal, a first terminal of the second reset module is electrically connected to the first node, and a second terminal of the second reset module is electrically connected to the first power signal terminal.

13. The driving circuit according to claim 1, further including:

a second driving transistor, a second storage module, a second boost module, and a second light-emitting control module, wherein:

a gate electrode of the second driving transistor is connected to a second node, a first electrode of the second driving transistor is connected to the light-emitting element, and a second electrode of the second driving transistor is connected to the first power signal terminal;

a first terminal of the second storage module is connected to the fixed voltage signal, and a second terminal of the second storage module is electrically connected to the second node;

a first terminal of the second boost module is connected to the boost signal terminal, and a second terminal of the second boost module is electrically connected to a second boost node; and the second light-emitting control module is connected in series between the second boost node and the second node.

14. The driving circuit according to claim 13, wherein:

the second boost module includes a second capacitor, wherein a first electrode of the second capacitor is configured as the first terminal of the second boost module, and a second electrode of the second capacitor is configured as the second terminal of the second boost module.

15. The driving circuit according to claim 13, wherein:

control terminals of the first light-emitting control module and the second light-emitting control module are connected to a same light-emitting control signal terminal, and the first light-emitting control module and the second light-emitting control module are in conduction simultaneously or cutoff simultaneously.

16. The driving circuit according to claim 13, wherein:

channel width-to-length ratios of the first driving transistor and the second driving transistor are equal to each other.

17. The driving circuit according to claim 16, wherein:

the channel width-to-length ratio of the first driving transistor is greater than 100.

18. The driving circuit according to claim 17, wherein:

the data write module includes a first transistor, wherein:

a gate electrode of the first transistor is configured as the control terminal of the data write module;

a first electrode of the first transistor is configured as the first terminal of the data write module; and a second electrode of the first transistor is configured as the second terminal of the data write module; and a channel width-to-length ratio of the first transistor is less than the channel width-to-length ratio of each of the first driving transistor and the second driving transistor.

19. The driving circuit according to claim 17, wherein:

a first reset module includes a second transistor, a second reset module includes a third transistor, the first light-emitting control module includes a fourth transistor, and the second light-emitting control module includes a fifth transistor, wherein:

channel width-to-length ratios of the second transistor, the third transistor, the fourth transistor, and the fifth transistor are equal to each other and are all smaller than the channel width-to-length ratio of the first driving transistor.

20. The driving circuit according to claim 19, wherein:

the first driving transistor, the second driving transistor, the first transistor, the second transistor, the third transistor, the fourth transistor, and the fifth transistor are all amorphous silicon thin-film transistors.

* * * * *